US012674313B2

(12) United States Patent
Olson

(10) Patent No.: US 12,674,313 B2
(45) Date of Patent: Jul. 7, 2026

(54) RESTRAINED JOINT APPARATUS AND METHOD FOR MAKING THE SAME

(71) Applicant: Norman L. Olson, Port Orchard, WA (US)

(72) Inventor: Norman L. Olson, Port Orchard, WA (US)

( * ) Notice: Subject to any disclaimer, the term of this patent is extended or adjusted under 35 U.S.C. 154(b) by 205 days.

(21) Appl. No.: 18/395,552

(22) Filed: Dec. 23, 2023

(65) Prior Publication Data

US 2025/0207383 A1 Jun. 26, 2025

(51) Int. Cl.
*E04B 1/26* (2006.01)

(52) U.S. Cl.
CPC .... *E04B 1/2604* (2013.01); *E04B 2001/2644* (2013.01); *E04B 2001/266* (2013.01); *E04B 2001/2684* (2013.01); *E04B 2001/2692* (2013.01)

(58) Field of Classification Search
CPC ..... E04B 1/2604; E04B 2001/2644; E04B 2001/266; E04B 2001/2684; E04B 2001/2692
See application file for complete search history.

(56) References Cited

U.S. PATENT DOCUMENTS 5,568,909 A * 10/1996 Timko ..... E04H 12/2269 52/298
6,640,517 B2 * 11/2003 Mitchell ..... F16B 17/006 403/361
6,694,700 B1 * 2/2004 Mackett ..... E04B 1/0046 411/404
8,631,626 B2 * 1/2014 Ballantine ..... E04B 1/2604 52/715
8,650,820 B2 * 2/2014 Bocquet ..... E04C 5/127 52/745.19
8,713,872 B2 * 5/2014 Rempel ..... E04B 1/2608 52/573.1
9,038,325 B1 * 5/2015 Callahan ..... E04F 15/02044 52/143
10,829,948 B1 * 11/2020 Bader ..... E04G 21/3233
2002/0194803 A1 * 12/2002 Mitchell ..... F16B 17/006 52/297
2007/0246623 A1 * 10/2007 Ehrhardt ..... E04B 1/26 248/218.4

(Continued)

*Primary Examiner* — Rodney Mintz
(74) *Attorney, Agent, or Firm* — Caseiro Burke LLC; Chris A. Caseiro

(57) ABSTRACT

A restrained joint apparatus, applications of the apparatus, and methods for making the apparatus are described. The apparatus is a wood-frame coupling that establishes the restrained joint with movement resistance and moment resistance of a wood member coupled with a frame. The frame includes a body with a wall. The frame can be a unitary structure wherein the wall of the body is arranged to replace an outer perimeter of the end of the wood member so that the wood member and the frame form the wood-frame coupling. In another embodiment, the frame is formed of a plurality of frame plates joined together about the perimeter of the wood member. The invention includes various applications for the wood-frame coupling where a restrained joint is useful. The invention includes a method of making the wood-frame coupling wherein the first described is forced onto and into the end of the wood member.

6 Claims, 35 Drawing Sheets

(56) References Cited

U.S. PATENT DOCUMENTS

| | | | | |
|---|---|---|---|---|
| 2012/0141706 | A1* | 6/2012 | Bocquet | E04C 5/127 29/527.1 |
| 2012/0297721 | A1* | 11/2012 | Rempel | E04B 1/2608 52/655.1 |
| 2013/0219822 | A1* | 8/2013 | Ballantine | E04B 1/2604 52/655.1 |
| 2015/0082735 | A1* | 3/2015 | Truckner | E04H 12/2253 52/655.1 |
| 2023/0151603 | A1* | 5/2023 | Irion | E04B 1/2604 403/265 |
| 2025/0003210 | A1* | 1/2025 | Whidden | E04B 1/2608 |
| 2025/0243667 | A1* | 7/2025 | Olson | E04C 3/18 |

* cited by examiner

RESTRAINED JOINT APPARATUS AND METHOD FOR MAKING THE SAME

BACKGROUND OF THE INVENTION

1. Field of the Invention

The present invention relates to mechanisms for restraining wood members to effect moment resistance thereof. More particularly, the present invention is a wood-frame coupling that establishes substantial control of movement of wood members in manners necessary for certain novel structural applications.

2. Description of the Prior Art

It is well understood that wood material shrinks and expands with changing moisture content. It is this aspect of wood material that is the reason that effective moment resistant joints, i.e., restrained joints, have not been achieved for use in the building industry. It is also well understood that wood material containing high moisture content is more prone to decay especially when placed in contact with earth soil or cementitious material. Treatment of the wood material with preservatives has allowed restrained joint construction at the base of a wood column by burying a portion of the treated wood member in the ground and/or encasing within concrete of compacted soil. The structures constructed using this type of design are widely used and most often referred to as pole buildings. Typically, a significant fraction of the overall column length is buried in the ground to develop the resistance needed to resist lateral forces but may have limited life due to decay depending on the specific conditions. Large diameter logs (non-dimensional lumber) are typically not utilized in this manner and thus have not been utilized in a manner to support significant lateral forces, instead they are used to only support vertical forces.

Early composite wood-steel post base connectors anchored to a concrete foundation provide a basis for vertical reaction to forces applied to a dimension column (post) but provide little or no resistance to lateral forces applied to the post so they are not considered restrained joints or moment resistant joints. These types of connectors have been used for many decades and are still widely used. Other types of wood-steel composite connectors provide a means to support wood beams and rafters but do not provide moment resistance.

Other apparent attempts to address moment resistance limitations of wood members involve providing a basis for reactions to both vertical and lateral forces applied to a wood column base but are limited in capacity to resist fully resist lateral movement, especially for serviceability loading. The wood member is inserted into the connector and then screw fasteners provide significantly to the contact strength of the wood-steel interface. However, small movement i.e.; rotation, of the wood member can still occur until the larger moment resistance of the connector can fully engage. It is this type of small rotation movement at the column base that extrapolates to noticeable movements at the top of the column. This type of movement is not about the strength of the connector to resist seismic and wind lateral forces but instead to resist noticeable movement for occupied upper floors, for example, and may be referred to as serviceability. In addition, these newer types of connectors don't solve issues for shrinkage and swelling that will further add to the serviceability movement issue.

Other apparent attempts to solve moment resistance of wood members include the use of connectors for large sized timber and manufactured lumber column members. These connectors provide support reaction to significant vertical forces applied to large sized columns. They may also provide a level of lateral resistance, but the lateral resistance capacity is not sufficient for large forces and thus are not to be defined as fully restrained. These connectors do not account for variability associated with moisture that causes wood expansion, which limits serviceability and does not address moment resistance.

The prior efforts to improve wood member structural connections do not provide a basis suitable to be used for large diameter log columns to provide a fully restraint joint at the base of the member. As a result, the use of a log column within the building industry is typically limited to vertical forces. The log column can support significant vertical forces but provides little or no contribution to the structure for resisting lateral forces. Historical and current practices for installing log columns within structures use the overall building lateral force resisting system to support the log timber columns laterally. Alternatively, steel members might be installed and hidden within the log column to provide a basis for lateral control. The log columns, while still connected to a concrete foundation, provide little or no lateral resistivity themselves and they can be a burden during construction because they must be temporarily supported until connected to the structure for permanent support.

Given the limitations of the prior art for providing moment resistant wood connections for beams, beam splices have been cumbersome and difficult to construct and generally considered a defect in the overall span of the wooden beam member. They often result in a significant reduction in overall beam strength, especially if the splice is located mid-span. Based on the prior art available, it is widely perceived that such mid-span wood beam splice connections should be avoided. It would be desirable to provide a mechanism that can be used to effectively reinforce wood members so that splice connections could be used without a loss of structural integrity.

What is needed is an apparatus to impart moment resistance to a wood member. Also, what is needed is such an apparatus that can maintain the benefits of using wood members as building structural members without requiring extensive supplemental support to account for the moment resistance need. Further, what is needed is a method for making such an apparatus.

SUMMARY OF THE INVENTION

It is an object of the present invention to provide an apparatus to impart moment resistance to a wood member. It is also an object of the invention to provide such an apparatus that imparts moment resistance to the wood member to allow application of wood members in manners not previously considered. Further, it is an object of the present invention to provide a method for making such an apparatus.

These and other objects are achieved with the present invention, which is a wood-frame coupling frame apparatus in the form of a structural frame of suitable strength and stiffness compared to the equivalent wood material properties, that is arranged for engagement with at least one end of a wood member so that the frame effectively replaces the outer perimeter of the wood member. That is distinct from prior known wood member connection concepts for supporting and connecting structural wood members that position such connection apparatus around the outer perimeter of the wood member and most often secured with fasteners. The replacement of the wood member's outer perimeter with the coupling frame substantially eliminates gaps between the two components so that the wood member does not move laterally, vertically, or rotationally, with respect to the frame. The configuration and fabrication of the current invention results in a substantially uniform contained compression acting outward from the bulk of the contained wood throughout the surface area of the inner walls of the coupling frame, thus acting as substantially uniform outward pressure. The result is that the wood-frame coupling provides the end of the wood member with sufficient confinement that translates to sufficient stiffness to provide moment resistance capacity to the wood member that eliminate movement of the wood member relative to the frame under loads expected for a structure under lateral loading conditions.

The wood-frame coupling may be connected via the combination or via at least the frame to a separate rigid building element or suitable foundation. Doing so substantially eliminates movement of the wood member relative to the building element or foundation as the wood member of the coupling does not move with respect to the frame. By the present invention essentially eliminating movement of the wood member where it contacts the coupling frame when acted on by forces ranging from serviceability loading to ultimate stress capacity loading, the present invention offers a myriad of potential applications not available with wood given current wood construction practices.

The present invention also includes a method of making the wood-frame coupling apparatus with the frame replacing the wood member outer perimeter through fabrication of the wood-frame coupling that develops a compression stress at their interface, thereby creating a structural pressure bond between the two components. A portion of the overall work generated during the fabrication method is directed laterally inward from the frame walls into the wood while undergoing containment production. The coupling frame insertion process directs a fraction of the overall system generated compressive force inward over the wood surface area in the form of stress. The resulting strain is trapped within the walls of the coupling frame by the subsequent containment. The contained compressed wood is both member bulk and disturbed outer wood fibers. The compressive force acting laterally inward over the distance of strain is the work harnessed as trapped energy to act outward as substantially uniform pressure onto the wood-frame interface surface area creating the wood-frame couple. The use of mechanical advantage facilitates application of a strong axial compression force to the wood member acting generally parallel with the wood grain.

During this fabrication method, the wood member is placed in a braced or restrained condition for substantially its length while the coupling frame is forced with a load axial to the wood member length onto either or both ends of the wood member. The wood member is placed in a restrained/braced condition to prohibit bucking of the wood member caused by the high axial compression force required to cause the frame to replace the outer perimeter of the wood member. The axial force pushes the wood member into the frame (or the frame into and onto the wood member), so that the frame pushes into essentially the entire perimeter of the wood member lateral to the wood member's long axis, thereby removing a layer of wood material from the outer perimeter of the wood member at a selectable thickness. The selectable thickness is determined based on the difference between the frame's inner wall dimensions compared to the wood member outer surface dimensions.

As the coupling frame is forced into the wood member perimeter, it compresses and encases wood material while reducing the cross-sectional area of the wood member where the replacement occurs. This method by which the frame reshapes and encases the member's bulk volume where the two components are engaged requires work in the form of high lateral compressive stresses acting inward on the wood bulk volume moving the wood surface inward with the associated elastic strain. The resultant joining of the two components generates such compressed (contained) strain that the engagement cannot be dislodged. Therefore, the work required to compress the member over the width of the elastic deformation is conserved in the form of prestressed compression energy acting outward from the wood bulk volume onto the inner perimeter of the frame. This compression bond minimizes voids between the two material surfaces and provides minimal spaces for the wood member to move with respect to the frame.

The prefabrication method of the invention ensures the structural elements have been produced in a controlled environment resulting in specifiable properties, such as connection strength capacity and member movement resistance standards. In an embodiment of the invention, the prefabrication is carried out on wood members that are relatively dry, such as wood members of certified dryness. The prestressed wood already in compression only increases that compressive force if moisture permeates the fibers. Conversely, the compressive load generated by forcing the frame into the wood member perimeter substantially prohibits significant moisture permeation—thereby maintaining wood member integrity. Thus, the shrink-swell dilemma experienced by prior connection and joint apparatus attempting to restrain wood members is solved. Moreover, the compressive barrier blocking significant moisture permeation reduces or eliminates chemical degradation and biodegradation that often occur within the pores of wet wood over time. It also reduces the need to pressure treat structural wood members with hazardous chemicals.

A benefit of prefabricating the wood-frame coupling in a controlled environment eliminates limitations associated with existing processes for connecting and restraining wood members. Specifically, the prior art has commonly used a design approach to create connectors by configuring the steel components dimensions to closely match the dimensions of the connecting wood member and supplement the connection between the materials using fasteners in the attempt to make a tight connection. These connections are not conducive to prefabrication. Instead, the wood-steel connector apparatus are constructed in the field where there is variability at the wood-steel interface that increases the likelihood of the wood moving within the steel connector apparatus so that it would effectively provide no moment resistance, unlike the present invention.

Whereas the prior process requires the builder to attempt to match the inner perimeter of a connector apparatus to the outer perimeter of the wood member, the present invention produces the wood-frame coupling apparatus by taking the opposite approach. That is, the wood member outer perimeter is forced to change to match the inner perimeter of the reinforcing frame. It is the present invention's method of wood-frame coupling production; i.e., prefabrication, that facilitates the production of a series of prefabricated structural elements easily connected in a segmental installation manner to simplify and accelerate what as otherwise been a field construction process. On this basis, the present invention allows wood members to be utilized in applications previously not possible or avoided based on practicalities because the required magnitude of restraint needed was unattainable based on the prior art methods and technology.

The present invention utilizes the relative strength of the frame material compared to the wood member material in the coupling apparatus to allow the wood member to resist forces and loading in an enhanced manner compared to the prior art. The invention establishes a restraint joint component, which may also be referred to as a moment resistant component. The method of making the wood-frame coupling facilitates segmental construction for structural wood members in a variety of applications. Such applications include, but are not limited to, the following examples.

Pole (column) based structures (often called "pole barns" in certain applications) can now use the present invention as a prefabricated wood-frame coupling with flange adaptor that can easily connect the foundation flange thus creating a moment resistant base. This is opposed to current practices whereby wood columns are embedded into the ground with concrete and/or soil to create a moment resistant base. These current practices require treated wood given exposure to concrete and/or soils. Instead, using the present invention, the columns do not require the insertion into ground or concrete and so does require chemical treatment of the wood member. Often the structures constructed using pole or column based lateral resistance are occupied by people. The present invention can eliminate the potential exposure to preservative treatment chemicals when the columns are located in the walls or interior of the inhabited structure.

Pre-fabricated mid-span wood beam splices made with the wood-frame coupling can now be approximately as strong as unspliced beams with stiffness significantly increased for reduced deflection. Splices have been previously avoided because they are cumbersome and comparatively weak and unreliable. With the present invention, prefabrication allows easy and quick installation, perhaps easier to install than unspliced beams given the longer length. The more splices in a beam using the present coupling actually makes the beam stiffer with less deflection than can occur with existing wood beams. As a result, a spliced wood beam with one or more wood-frame couplings of the present invention may allow replacement of much heavier steel beams in certain applications, for example. The fact that the wood member's cross sectional dimension is reduced by the amount of perimeter wood thickness replaced by the present coupling frame reduces the capacity of the member to resist force induced stress at the location where the wood-frame ends does not necessarily translate into reduced force resisting capacity of the overall system. In most applications the slight reduction in wood member strength capacity is offset by the fact that the coupling frame length reduces the member length that is exposed to resist said forces. Given the deflection and acting moment stress magnitudes that result when the wood member resists applied forces are a function of the member length factored exponentially, the reduced cross section most often doesn't diminish the relative strength and stiffness when the overall member and coupling frame are considered.

Log columns prefabricated with a moment resistant base established using the wood-frame coupling of the present invention joined to a connection flange can now be utilized in the construction industry to allow large lateral and gravity forces to be resisted with log columns, with or without supplemental compression struts. Compression struts can optionally be used to further increase the laterally resisting capabilities of the column. The struts may be added to the pre-fabricated wood-frame coupling apparatus for large logs and timber columns when the support is based on a flanged configuration and the wood-frame coupling is smaller in cross section compared to the overall cross section of the log or timber column. Screw jack struts can be quickly connected to flange bolts to provide a compression force to supplement the wood-frame coupling to resist lateral forces. The entire coupling frame joint with struts already in place and pre-stressed can be delivered for one step installation onto a reception foundation flange.

Pre-fabricated flange connection to various forms of foundation reinforcement allows for simple base flange placement into concrete foundations, whether spread footing type or deeper drilled pier type foundations. Wooden moment frames, including portal frames, can now be constructed and eliminate the need for shear walls and bracing for the lateral resisting system where it makes sense. Restrained joints can now be used from the foundation connection through the column beam connections.

Segmental construction can be carried out using the wood-frame coupling with multiple beam and column lengths, prefabricated steel flanges, and additional bend fittings prefabricated for desired vertical and horizontal alignment at joints. Segmental framing for structures can be carried out using prefabricated elements including using one or more of the wood-frame couplings at strategic locations of the segmented construction using a simple tool set and fewer workers.

Log beams can be spliced with prefabricated splice/flanges adaptors allowing the same diameter log to span long distances without the natural log taper impacting the span length. Inverted truss technology can be applied by simply sandwiching the king post (as a flat bar) between the prefabricated beam splice flanges. Segmental construction of inverted truss systems allows on-site installation of high strength beams using relatively light weight transportable materials and members. Beam camber can be easily added as desired at the span joint by inserting a shim between the bean splice flanges.

Flanged steel columns members and wood members prefabricated with flanged wood-frame couplings of the present invention can be inter-mixed in configurations that leverage the steel strength where needed but still keep the overall construction relatively light weight given the large fraction of wood still utilized in the application. Applications where the capacity of long span wood beams are governed by deflection limits, not by moment capacity, may not need to be upsized if the wood-frame coupling splice is added to increase stiffness. This can reduce the cost to purchase and handle the long span glulam and other manufactured beams as well. Other structural wood columns using manufactured wood, such as cross-laminated timbers for example, may be designed into particular configurations using the wood-frame coupling of the present invention to provide restrained joints at column-column connections, column-beam connections, and column foundation connections.

The present invention may be described as relating to mechanisms for restraining wood members to effect moment resistance thereof. More particularly, the present invention is a coupling frame that is either inserted into and onto, or constructed onto an end of the wood member to enhance substantially the ability to control key physical properties of the wood member that are important for structural applications. Still more particularly, the inserted or constructed coupling frame completely engages with the entirety of the end of the wood member through full confinement of strain resulting from a strong compression force exerted during frame insertion or construction. Containment of the strained wood material translates into a substantially uniform contained compression acting outward from the wood bulk onto all inner surfaces of the frame creating a strong wood-frame couple. The contained compressive engagement between the wood and frame is permanent and limits all movement of the wood relative to the frame and reduces moisture access to the contained wood surface and interior.

The present invention may also be described as relating to mechanisms for restraining wood members to effect moment resistant joints thereof. More particularly, the present invention is a frame that is mechanically placed on an end of the wood member to enhance substantially the ability to control movement of the wood member that is important for structural applications. Still more particularly, the frame completely engages with the entirety of the end of a wood member through permanent containment of strain developed through the application of high intensity mechanically generated compression force applied during the fabrication of the wood-frame connection. The strain trapped within the wood-frame connection as work-energy is permanently maintained as high magnitude constrained compression that is a strong wood-frame couple. The compressive engagement between the wood and frame prohibits all movement of the wood relative to the frame, including laterally, axially, and rotationally, and reduces moisture intrusion into the contained wood. The use of the wood-frame couple to construct moment resistant joints for wood construction applications is a significant improvement compared with the prior art.

The invention includes a frame for making a wood-frame coupling to establish a joint that provides movement resistance and moment resistance to a wood member having an outer perimeter and an end, wherein the frame is coupled to the wood member at the end thereof. The frame includes a body including a wall characterized by an outer wall and an inner wall that establishes an inner perimeter. The wall defines an inner space within the inner wall configured to receive a portion of the end of the wood member therein. The wall is dimensioned so that the inner perimeter thereof is smaller in magnitude than the outer perimeter of the wood member at the end, and the wall of the body of the frame is arranged to replace an outer perimeter of the end of the wood member so that the wood member and the frame form the wood-frame coupling.

In an alternative embodiment of the wood-frame coupling, the frame includes a plurality of frame plates having edges. The plurality of frame plates are joined together to establish a body that establishes an inner perimeter about the outer perimeter of the wood member at the end thereof. The plurality of frame plates are joined together after placement about the end of the wood member to establish static contained compression of the end of the wood member at the outer perimeter thereof, so that the wood member and the frame established about the wood member form the wood-frame coupling.

In addition, an aspect of the invention is an apparatus for making a wood-frame coupling by joining together an end of a wood member and a frame. The apparatus includes a platform for removably retaining the wood member thereon, an axial load generator arranged to force the frame on and into the end of the wood member, a directional guide to control application and direction of the force generated by the axial load generator, an alignment guide to control relative movements of the end of the wood member and the frame, an axial wood restraint, and one or more lateral wood restraints arranged to secure the wood member to the platform while operating the axial load generator. It is noted that other types of apparatuses may be employed to make the wood-frame coupling.

The apparatus described above or another apparatus may be used to carry out a method of making the wood-frame coupling. The method involves making the wood-frame coupling for establishing moment resistance of the wood member by forcing the frame on and into an end of the wood member by carrying out the steps of securing the wood member to a platform, positioning the frame in contact with the end of the wood member, wherein an inner perimeter of the frame is substantially the same as an outer perimeter of the end of the wood member but smaller, and forcing the frame on and into the end of the wood member to establish the wood-frame coupling.

In another method, a prefabricated structural column is formed using the wood-frame coupling that includes the frame and the wood member joined together to establish moment resistance of the wood member, wherein the frame includes a flange. This method includes the steps of securing a structural body to a substrate, wherein the structural body includes the flange, positioning the wood member with the wood-frame coupling adjacent to the structural body, and securing the flange of the wood-frame coupling to the flange of the structural body.

The invention also includes a method of making a segmented structure formed of a plurality of wood members, wherein each wood member has at least one wood-frame coupling that includes the frame and the wood member joined together to establish moment resistance of the wood member. The method includes the step of securing the first wood member to the second wood member. The first wood member and the second wood member may be beams, or one may be a beam and the other may be a column. The wood members may be joined together at the wood-frame coupling or not. They may include flanges and the flanges may or may not be used to join the first wood member and the second wood member together.

The invention further includes a method of joining together a first wood member and a second wood member. Each wood member has at least one wood-frame coupling that includes a frame joined to at least one end of the wood member to establish moment resistance of the wood member beam. The method includes the steps of connecting a first end of a receiver to an end of one of the first wood member and the second wood member, wherein the receiver is arranged to receive therein the wood-frame coupling of the first wood member or the second wood member, and connecting a second end of the receiver to an end of the other of the first wood member and the second wood member, wherein the receiver connects the first wood member and the second wood member together.

The present invention includes production of prefabricated structural elements and members associated with specific applications of the wood-frame coupling as well as a method of segmental construction and installation utilizing said prefabricated elements and members. These and other features and advantages of the present invention will be understood by one of skill in the art upon review of the following detailed description, accompanying drawings, and appended claims.

DETAILED DESCRIPTION OF THE INVENTION

Figure 1:
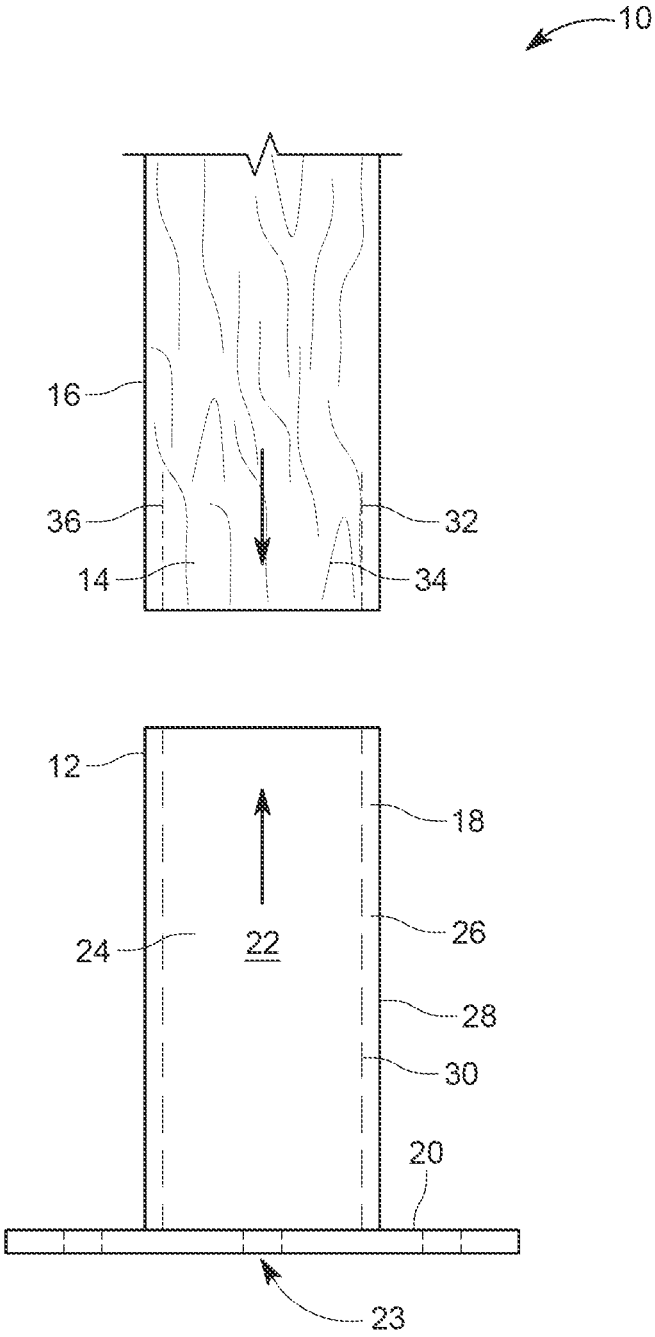
FIG. 1 is a side view of the frame and the wood member before joining together to form the wood-frame coupling apparatus of the present invention.
Figure 2:
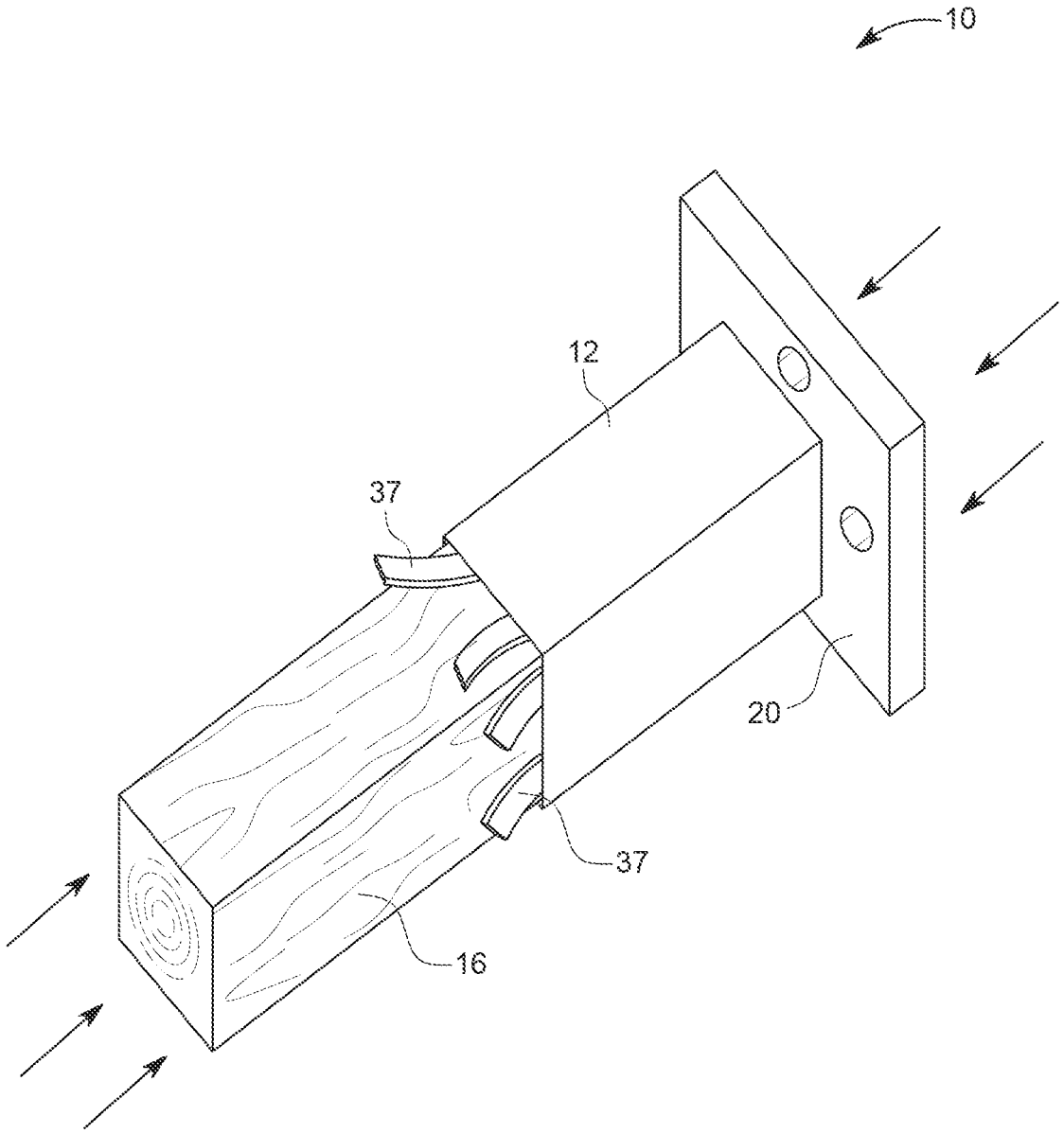
FIG. 2 is a perspective view of the frame and the wood member joining together with representations of the forces that cause the joining together of those two components.

A wood-frame coupling 10 of the present invention is shown in FIGS. 1 and 2. The wood-frame coupling 10 includes a frame 12 joined to an end 14 of a wood member 16. The frame is made of steel that may be coated or otherwise treated to minimize corrosion. Alternatively, the frame 12 may be made of another structural material, such as another metallic material, a nonmetallic material, or a combination of materials. The frame 12 includes body 18 and, optionally, a flange 20, or other appurtenances such as hooks, clamps, receivers, examples of which are described herein. The flange 20 may be welded or otherwise attached to the body 18. The flange 20 may be solid or it may be tubular. Flange 20 may include a pre-drilled hole to allow air pressure relief during the joining of frame 12 to end 14 of a wood member. The body 18 may be of a rectangular shape of configuration similar to that of the shape of the wood member 16 where the wood member 16 and the frame 12 are joined together. The body 18 may also be of a cylindrical shape such as cylindrical body 18' shown in FIG. 4. Other shapes of the body 18 are possible. The form of the body 18 establishes a tube that is rectangular, an annulus, or other form dependent on the shape of the body 18. The body establishes an inner space 22 into which a portion of the end 14 of the wood member 16 is forced via opening 24 of the body 18.

The body 18 of the frame 12 includes a frame wall 26 that is characterized by an outer wall 28 and an inner wall 30. The thickness of the wall 26 is selectable dependent on the specific construction of the wood-frame coupling 10 as described herein. In an example embodiment of the invention, the thickness of the wall 26 is about ⅜-inch but not limited thereto. The length of the body 18 of the frame 12 is selectable dependent upon the cross-sectional area size and moment resistance required for the wood member 16. In an example of the invention, the length of the body 18 is about 12 inches so that the portion of the end 14 of the wood member 16 that enters the inner space 22 of the body 18 is about 12 inches when the end 14 substantially fills the inner space 22.

The wood member 16 is of selectable size and shape. The end 14 of the wood member 16 has a cross sectional area that is relatively the same as the cross sectional area of the body 18 of the frame 12 as measured at the outer wall 28. More specifically, the cross sectional area of the body 18 at the outer wall 28 is about the same as the cross sectional area of the end 14 of the wood member 16 but generally slightly larger depending on the body 18 material and thickness. When the wood-frame coupling 10 is formed, the body 18 and the wood member 16 are forced together so that the wall 26 of the body replaces an outer portion 32 of the perimeter of the end 14 of the wood member 16. Interior portion 34 of the end 14 of the wood member 16 is forced into the inner space 22 of the body 18. Wall 36 of the end 14 contacts substantially inner wall 30 of the body 18, resulting in substantially uniform constrained compression acting as pressure on the end 14 of the wood member, effectively preventing substantially any movement of the end 14 in the frame 12 and, correspondingly, substantially limiting any lateral or rotational movement of the entire wood member 16 based on the connection to body 18. The resulting constrained compression between inner wall 30 and end 14 is permanent pressure that can only increase in magnitude due to added moisture content of wood member 16 at end 14 from the initially substantially ensured dried condition if moisture content can increase when already experiencing a constrained compression environment.

The wood-frame coupling 10 formed as described herein may be used in a variety of ways to establish structural members of buildings, and other structures, tools, devices, etc., i.e., wherever useful, using wood in applications not considered before because moment resistant joints using wood were not available. The wood-frame coupling 10 forming a component of the wood member 16 enables usage of the wood member 16 with little or no reinforcement and to replace steel structural members in some instances. Example usages of the wood-frame coupling 10 are described herein but it is to be understood that the usage of the invention is not intended to be limited to these examples.

Figure 3:
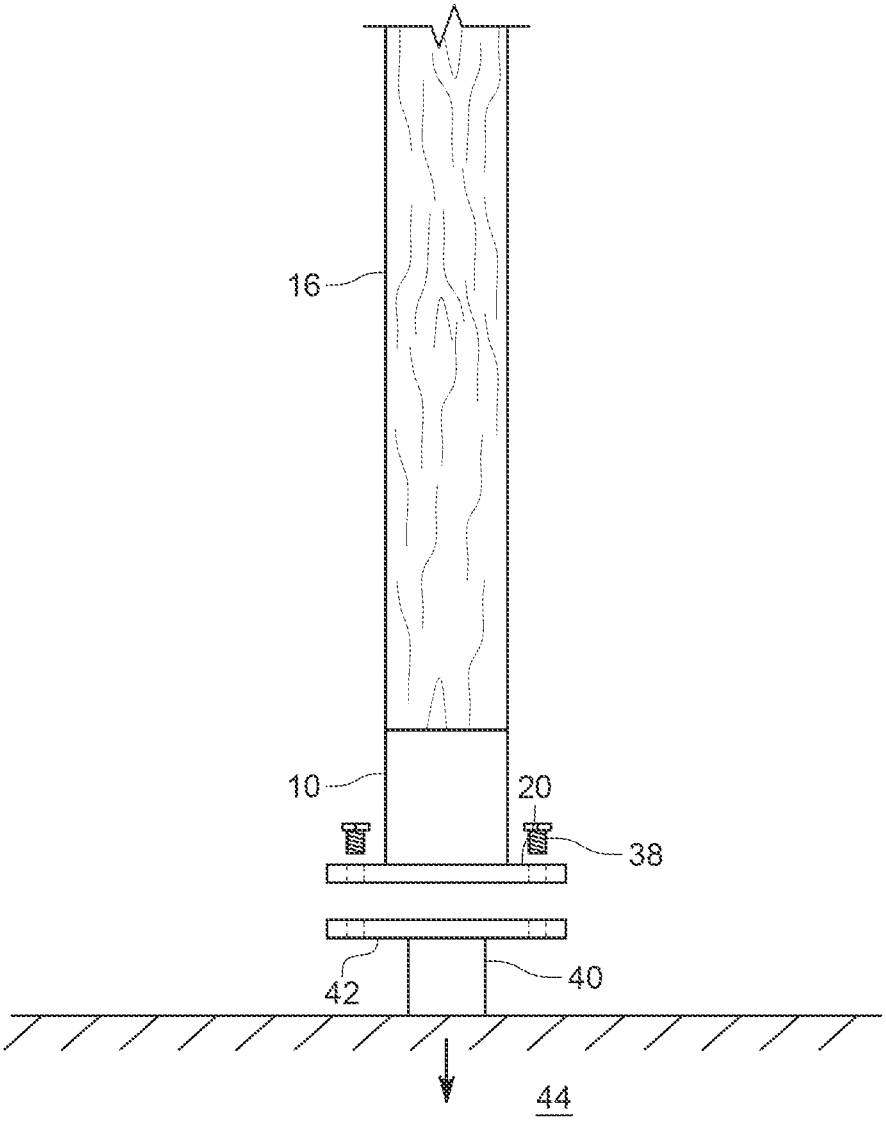
FIG. 3 is a cross sectional side view of the wood-frame coupling in position restraining the wood member and showing an optional coupling mechanism for affixing the wood-frame coupling to a foundation.

FIG. 3 shows wood member 16 with wood-frame coupling 10 having the flange 20 wherein the flange 20 can be bolted with bolts 38 to a non-wood structural member 40 with joining flange 42. The non-wood structural member 40 may be made of steel or other suitable material and is embedded in foundation 44. When the flange 20 is coupled to the joining flange 42, the wood member 16 is effectively secured to the foundation 44 without the need to insert the wood member 16 into the foundation 44. That minimizes the chance that the wood member 16 will decay over time while in the foundation 44 and so preservative treatment of the wood member is not required. It also reduces the required length of the wood member 16 as it is no longer necessary to insert a substantial portion of the wood member 16 into the foundation 44 to establish moment resistance.

Figure 4:
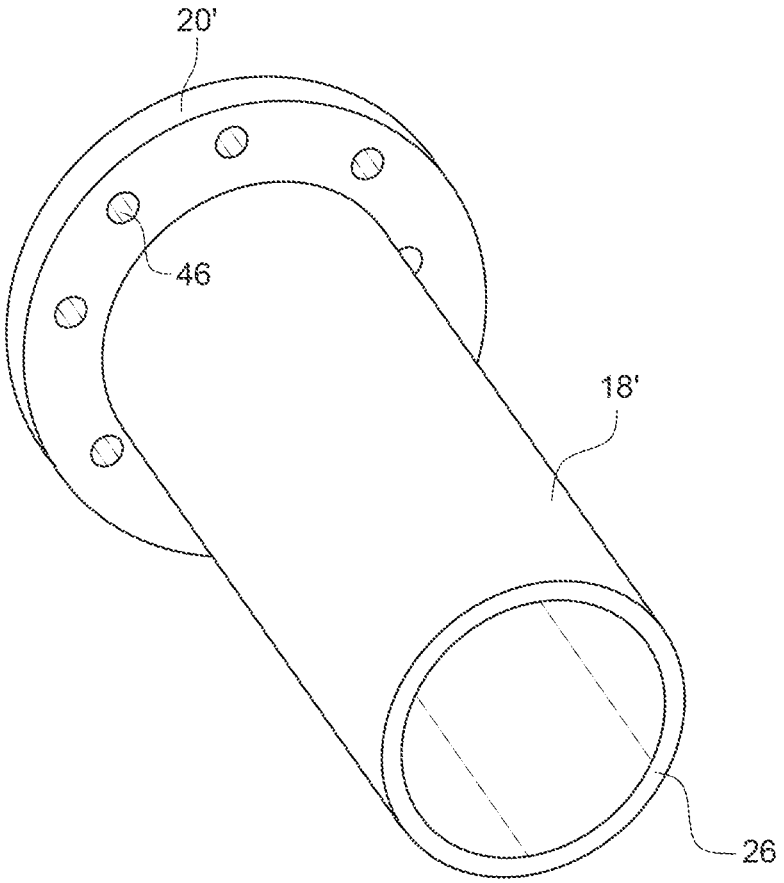
FIG. 4 is a perspective view of a cylindrical embodiment of the frame of the present invention.
Figure 5:
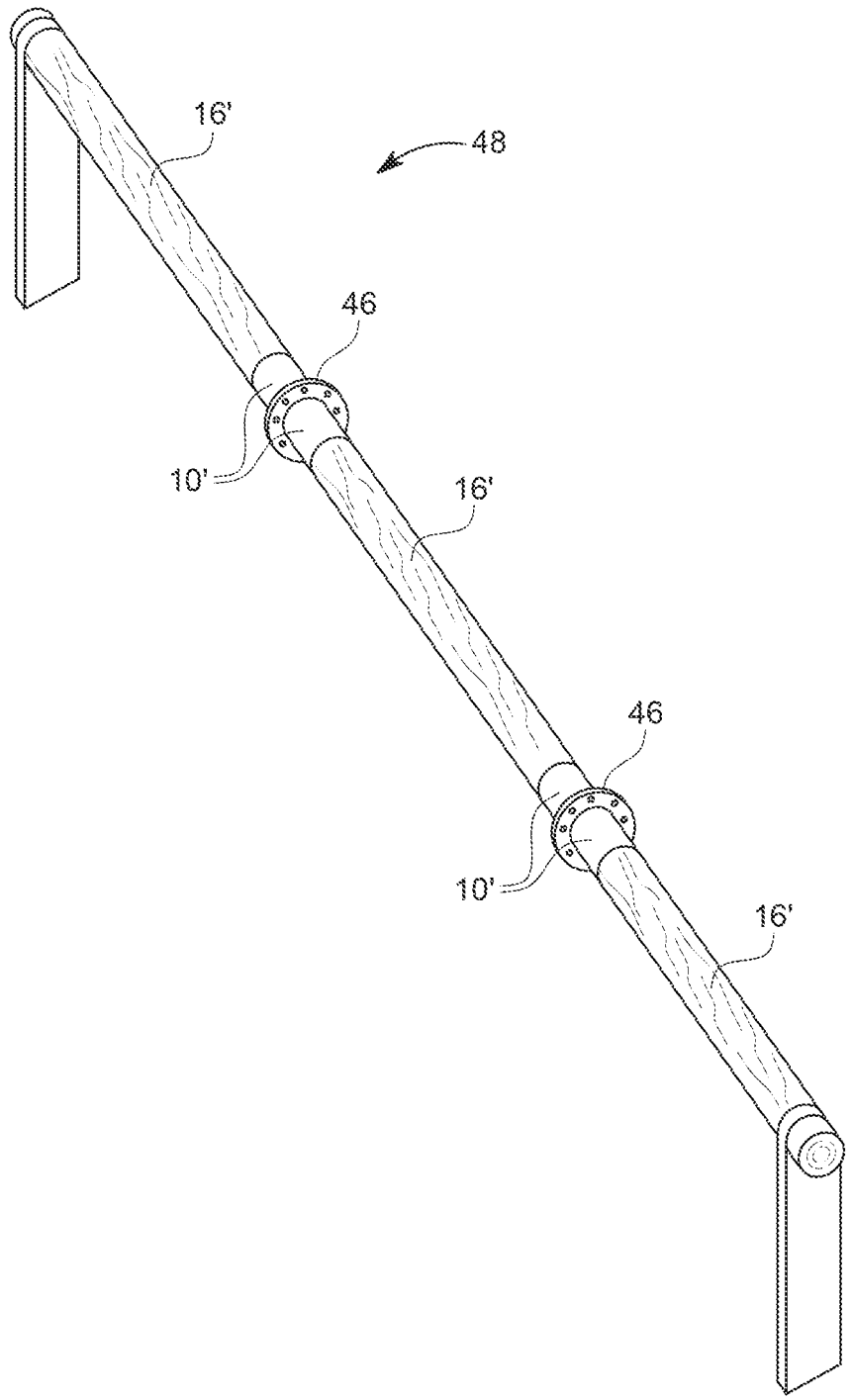
FIG. 5 is a perspective view of the frame of FIG. 4 in conjunction with a cylindrical wood member showing a plurality of wood-frame couplings forming a cylindrical segmented beam.

With reference to FIGS. 4 and 5, the cylindrical frame body 18' with corresponding cylindrical frame 20' may be used to form wood-frame coupling 10' when there is a cylindrical wood member 16'. The frame 20' includes bolt holes 46 for receiving bolts to secure two wood-frame couplings 10' together. The joining together of a plurality of wood members 16' establishes a segmented beam 48. The segmented beam 48 with one or more wood-frame couplings 10' is much less likely to deflect under expected loading as compared to a wood beam that is not segmented.

Figure 6:
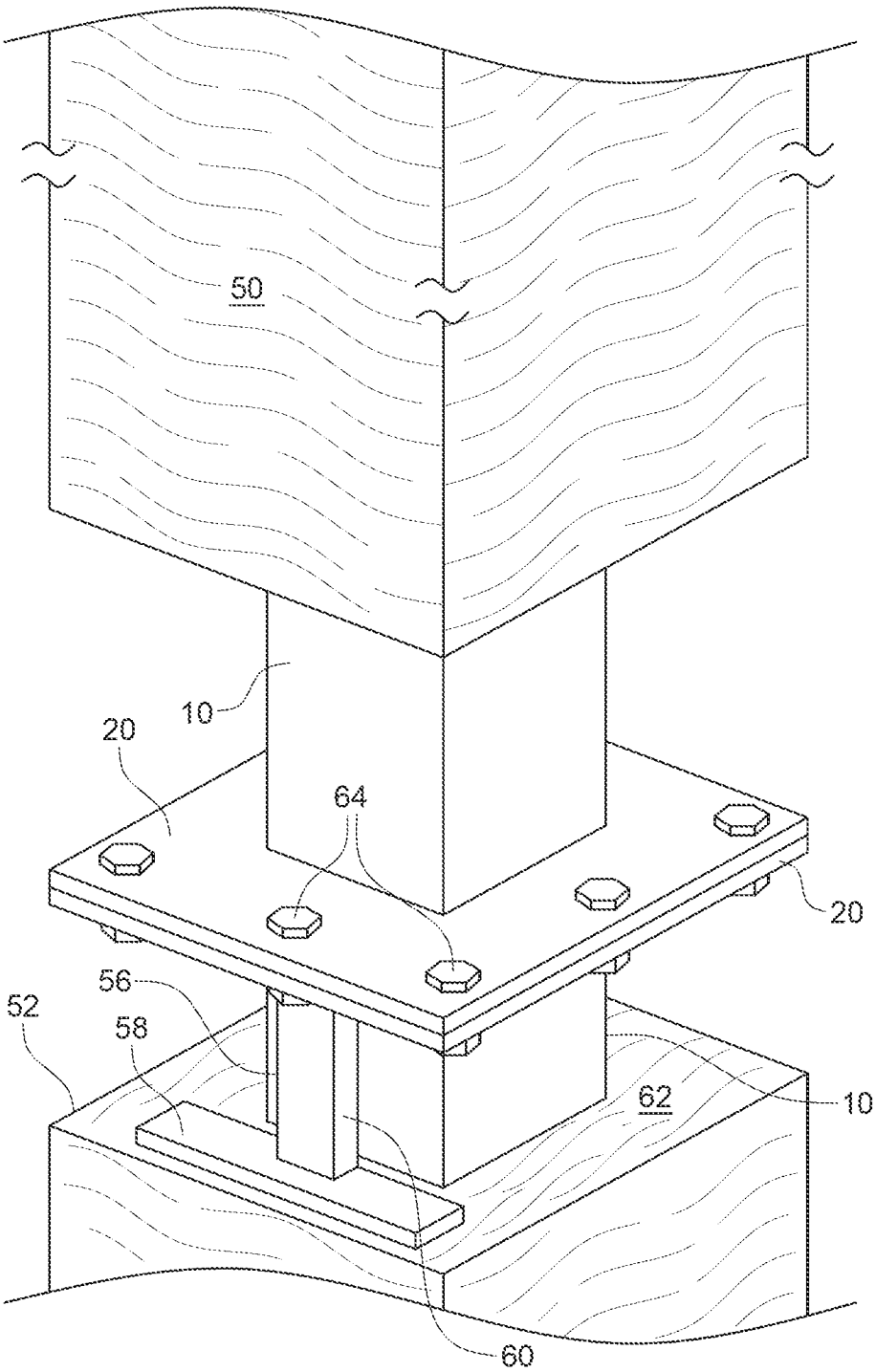
FIG. 6 is a perspective view of an embodiment of using the wood-frame coupling to join together two columns that have transverse cross sectional areas greater than the transverse cross sectional area of the wood-frame coupling and showing an optional embodiment with struts to both aid in securing the two wood-frame coupling together and to augment the overall lateral force resistance capability of the joint.

FIG. 6 shows an example of a pair of wood-frame couplings 10 to join together an upper column 50 and a lower column 52, wherein the cross sectional areas of the upper column 50 and the lower column 52 exceed the cross sectional areas of the two wood-frame couplings 10. Each of the wood-frame couplings 10 includes the flange 20. The configuration of FIG. 6 enables the joining of the two columns 50 and 52 with structural integrity having moment restraint provided by the couplings 10. The structure of FIG. 6 further includes one or more optional compression struts 56 to add moment resistance beyond the coupling 10 capacity given the reduced cross sectional area of member end 14 (FIG. 1) relative to column 50 or 52 (member 16 of FIG. 1) cross sectional area outside body 18. Additionally, struts 56 aid in reinforcing the connection between the two couplings 10 as well. Each strut 56 includes a strut bearing plate 58 and a strut screw jack 60. The strut screw jack 60 is joined to the strut bearing plate 58, and the strut bearing plate 58 is connected through compression to a surface 62 of the column 50/52.

Alternatively, strut 58 may also be connected to member 16 (FIG. 1) surface by other means in addition to compression. The flanges 20 of the two couplings 10 are joined together with one or more fasteners, such as bolts 64. The bolts 64 are also arranged to connect the strut screw jack 60 to one or both of the flanges 20.

Figure 7:
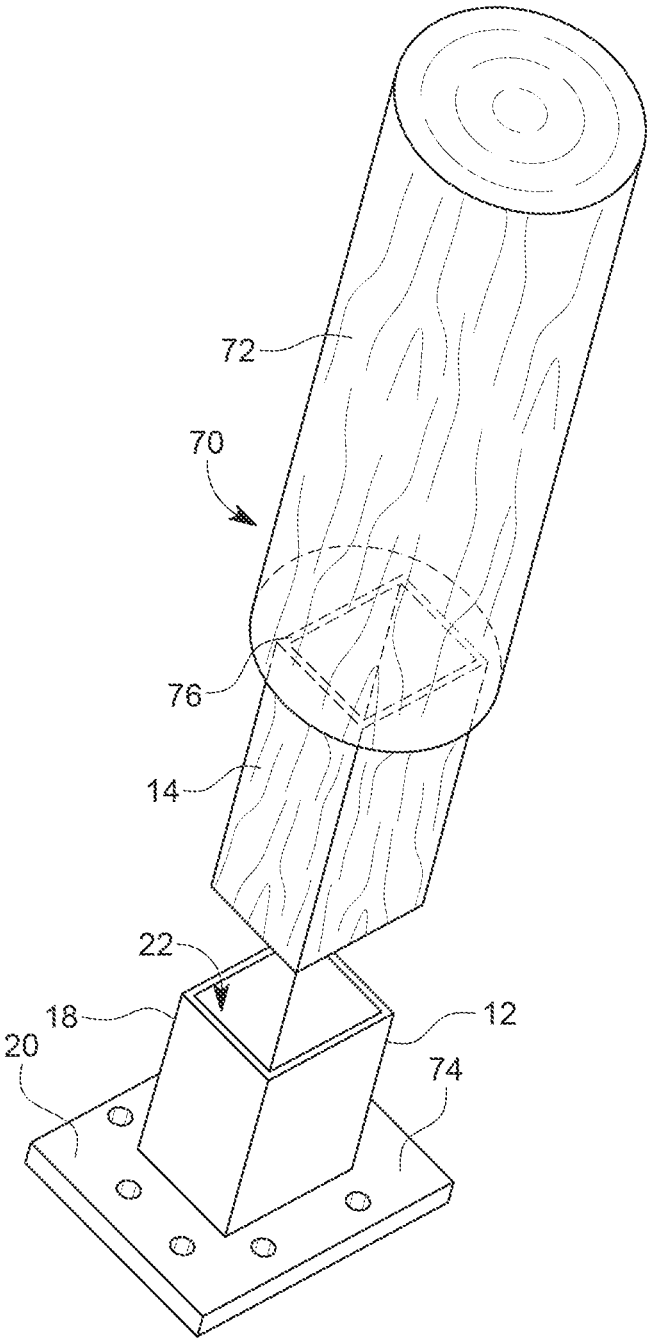
FIG. 7 is a perspective view of the wood-frame coupling with the wood member of the coupling in a rectangular form transitioning to a cylindrical wood column.

FIG. 7 shows the wood-frame coupling 10 with the end 14 spaced from the body 18 prior to insertion into the space 22. The end 14 is an integral part of, or a connected section of, a transitional wood member 70. The transitional wood member 70 includes the end 14 and a wider body 72. The structure of FIG. 7 may be reinforced such as with one or more struts 56 shown in FIG. 6, wherein the bearing plate 58 is affixed to surface 74 of the flange 20, and the strut screw jack 60 compressed against and optionally connected to underside 76 of the wider body 72. The flange 20 may be affixed to a substrate such as a foundation or it may be connected to another flange that is part of the wood-frame coupling 10 of another wood structure that may mirror the transitional wood member 70 or may be a different wood structure.

Figure 8:
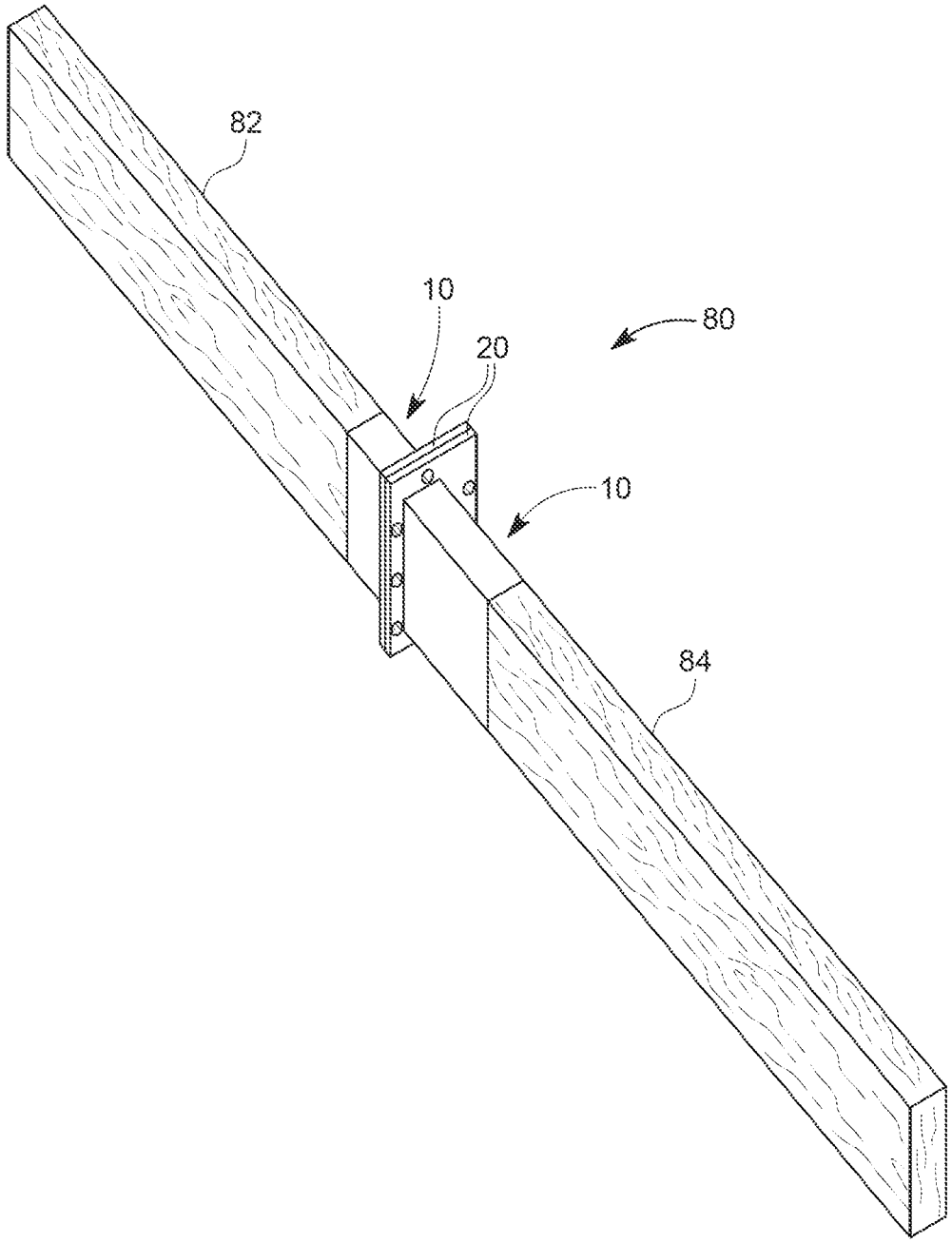
FIG. 8 is a perspective view of an embodiment of the invention showing two wood-frame couplings joined together for a rectangular segmented beam.
Figure 9:
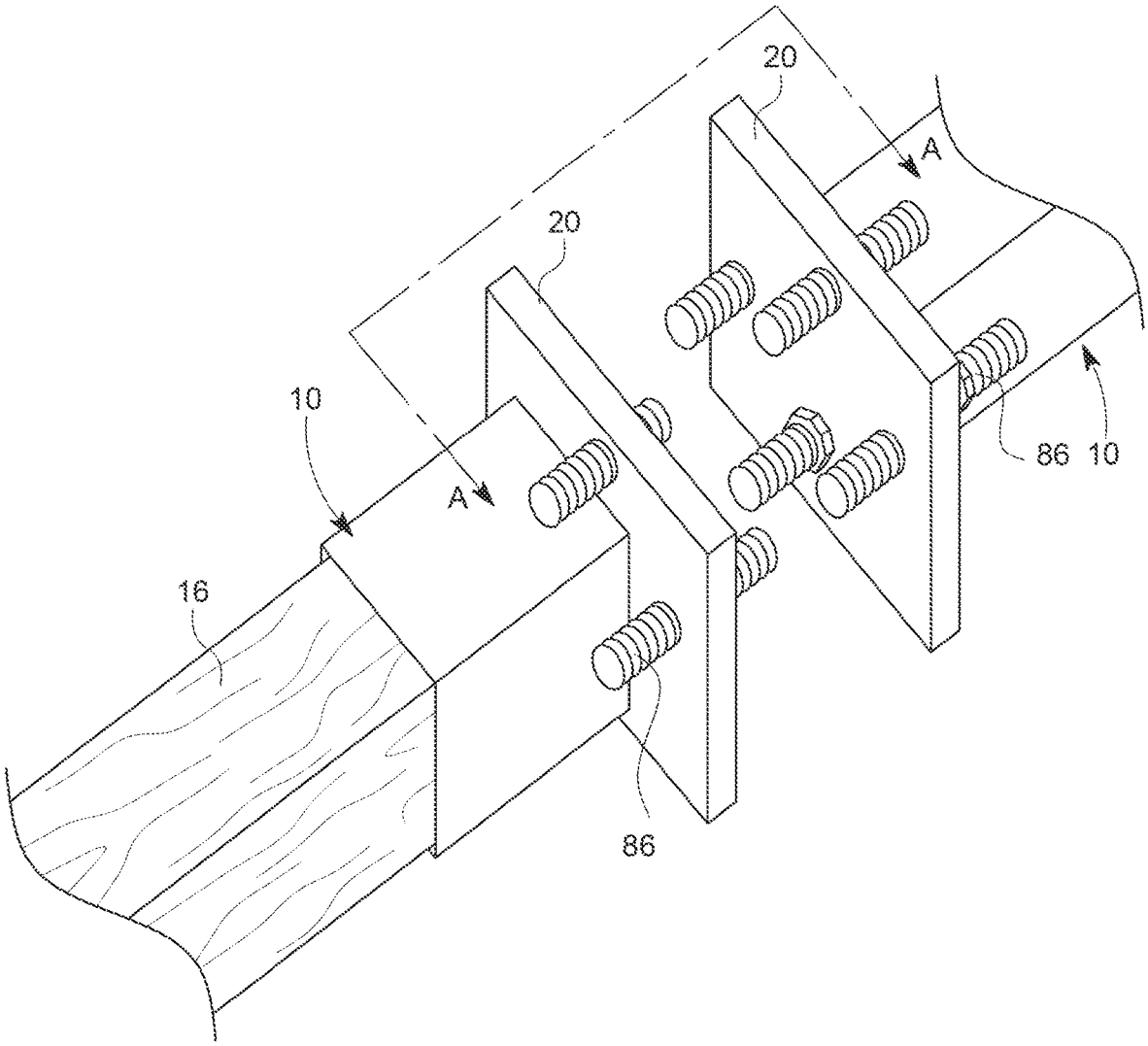
FIG. 9 is a showing the rectangular segmented beam of FIG. 8 prior to joining the two wood-frame couplings together.
Figure 10:
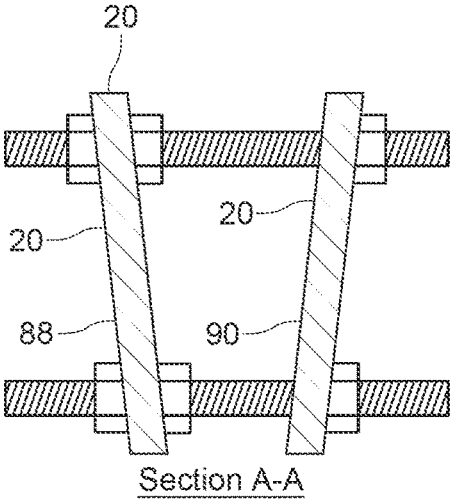
FIG. 10 is a close side view of an optional angled joining of two wood-frame couplings together for a segmented beam with one segment angled with respect to another segment.

FIG. 8 shows a spliced wood beam 80 formed of two wood members 82 and 84. Each of the two wood members 82 and 84 includes the wood-frame coupling 10, wherein the respective ones of the two wood-frame couplings 10 are joined together. Spliced wood beam 80 may be useful for certain applications. Two examples being: applications where combined length of wood members 82 and 84 is not practical for construction, and applications where moment resistance provided by mid span wood frame couplings reduces overall deflection compared to unspliced wood beam of length equivalent to spliced wood beam 80. FIG. 9 shows the wood-frame couplings 10 prior to joining the wood members 82 and 84 together. Bolts 86 may be used to join together the two couplings 10. FIG. 10 shows an optional arrangement for joining together the flanges 20 wherein flange 88 may be offset from alignment with flange 90 to allow the user to selectably establish angling of one wood beam with respect to another wood beam in a splicing arrangement. It is to be noted that either or both of flanges 88 and 90 may be of an offset alignment.

Figure 11:
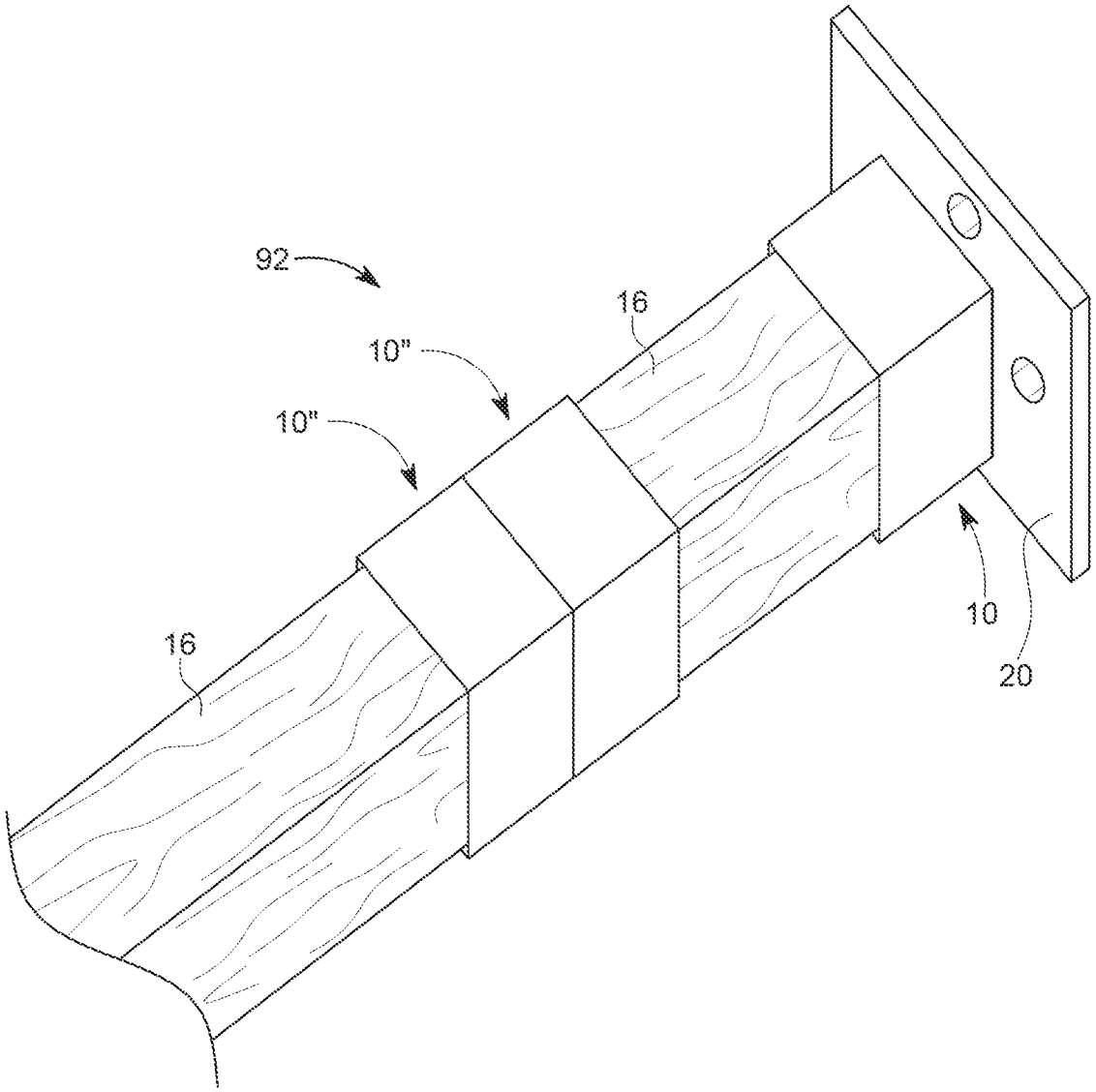
FIG. 11 is a perspective view of a rectangular segmented beam joined together with two wood-frame couplings wherein the two couplings are welded together rather than bolted together.

An option of the configuration of the couplings is shown in FIG. 11 to form a spliced beam 92. Wood-frame coupling body 18 is pre-connected to a second wood-frame coupling body 18. FIG. 11 shows the connection of the two body 18 end to end making a sleeve, wherein the sleeve is first positioned on one wood member 16 to form coupling 10 then on the second wood member 16 to form the second coupling 10 thereby joining both wood members 16 together end to end in a sleeved like manner. The couplings 10 do not have a flange but are instead secured together from pre-welding before the first coupling 10 occurs. One or both of the wood members 16 may additionally include the wood-frame coupling 10 with flange 20 at an opposing end of the wood member 16 for connecting to a substrate, another spliced beam 92, or another structure.

Figure 12A:
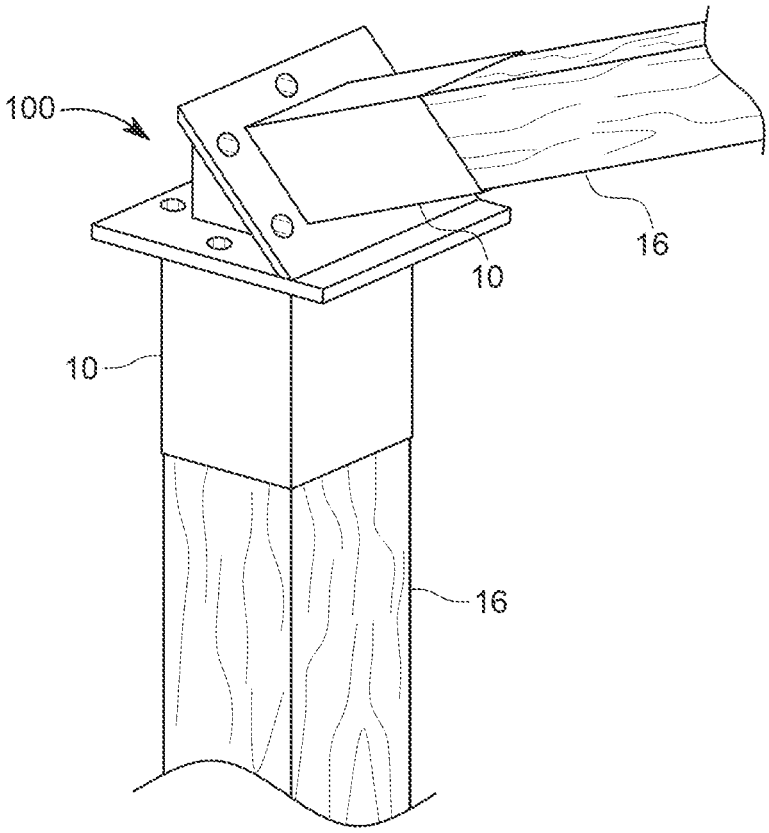
FIG. 12A is a perspective view of an example of two beams joined together at an angle using a fitting.
Figure 12B:
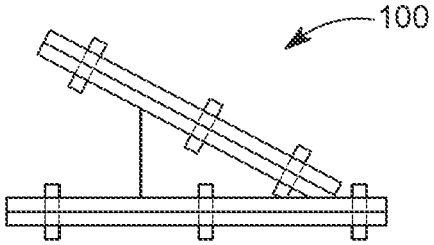
FIG. 12B is a side view of the fitting.
Figure 12C:
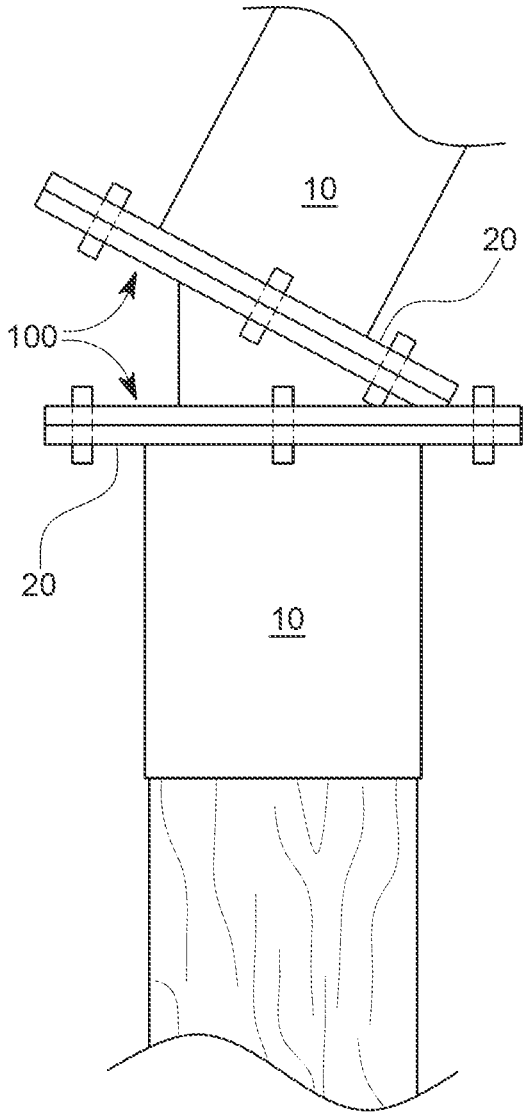
FIG. 12C is a side view of the beams joined together.

FIGS. 12A-12C illustrate an example of an optional fitting 100 for joining two wood members 16 together at an angle. The fitting 100 is of selectable shape, such as a triangle, with sufficient structural integrity to maintain a connection between two wood-frame couplings 10 at an angle thereof. The fitting 100 may also be attached to the couplings 10 or otherwise arranged to join them together at a cant to one another. Other fitting configurations are possible to make any selectable angle between two couplings 10.

Figure 13:
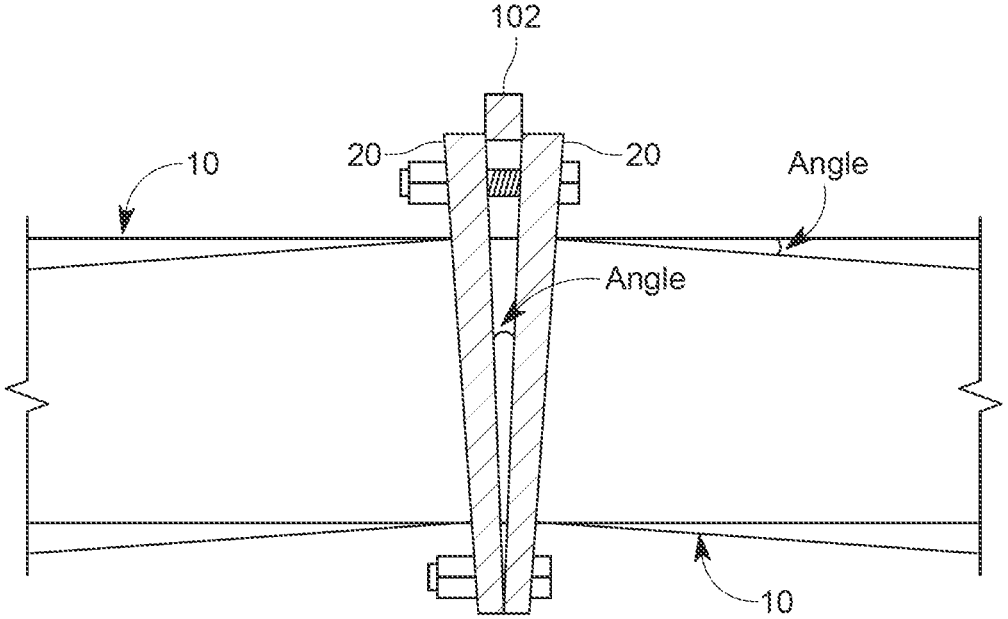
FIG. 13 is a cross sectional side view of joining together two wood-frame couplings with a cambered shim to angle two wood beam segments with respect to one another.

FIG. 13 shows an optional shim 102 that may be used to add camber into a spliced beam including two wood members. The shim 102 is of selectable thickness, length, and taper to regulate in fine detail an angle of the two wood members with respect to one another.

Figure 14:
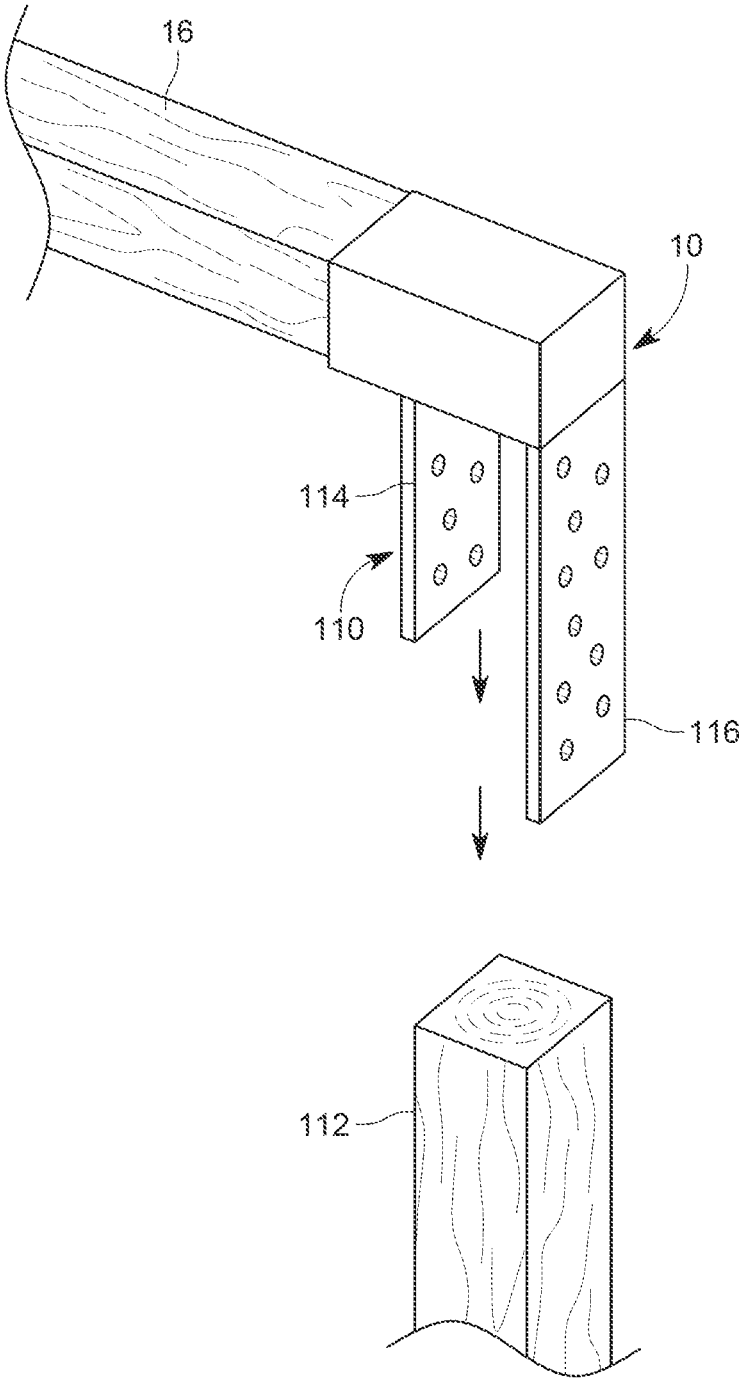
FIG. 14 is a perspective view of an example wood-frame coupling for joining a beam to a column together at a right angle where part of the connector uses traditional steel strap with fastener technology and part uses the wood-frame coupling.
Figure 15:
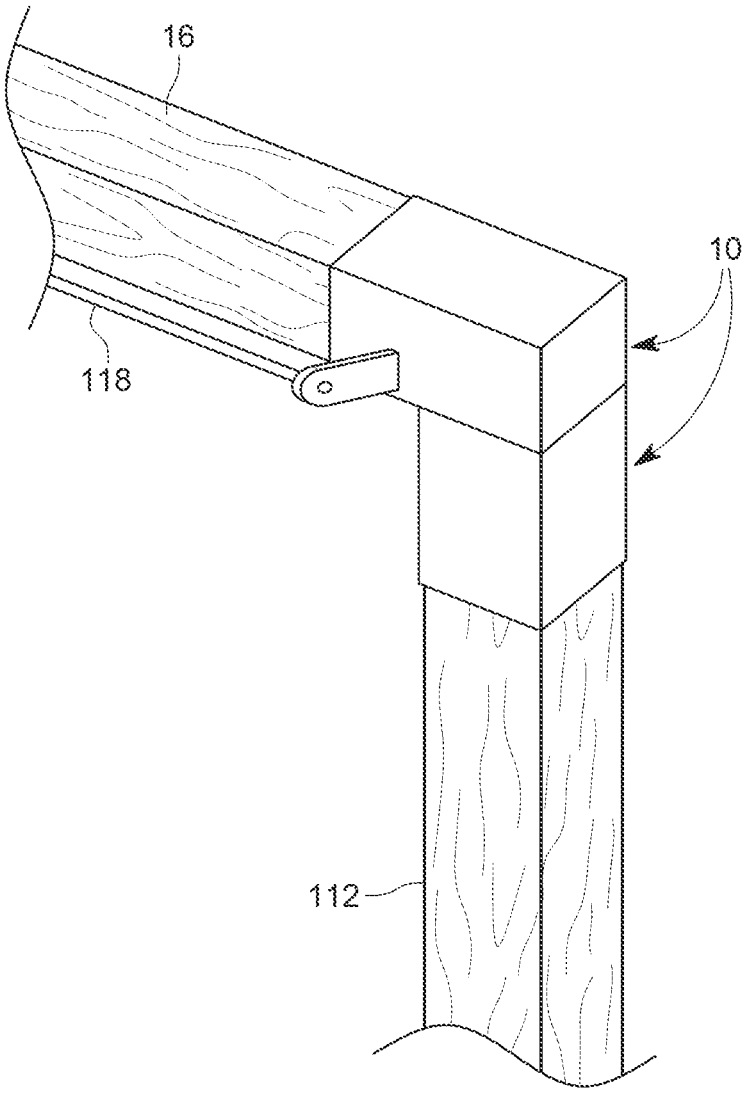
FIG. 15 is a perspective view of an example wood-frame coupling for joining a beam to a column together at a right angle and an optional tension cable to create an inverted truss configuration is included.
Figure 16:
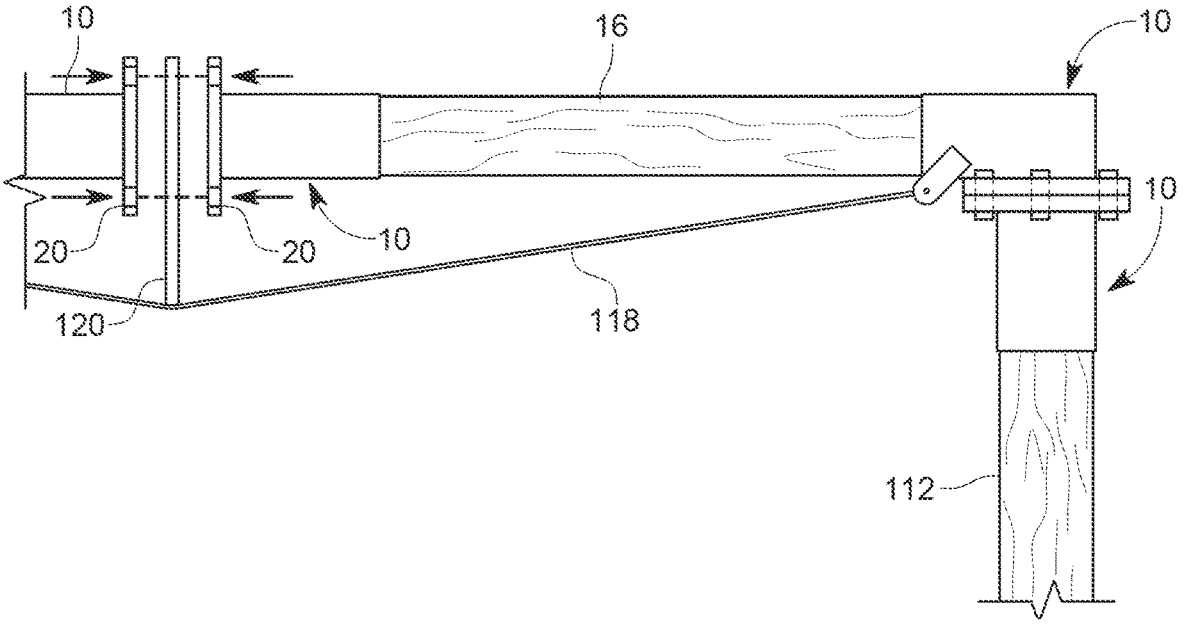
FIG. 16 is a side view of the joining of FIG. 15 showing the optional tension cable connected to the second coupling pair.

FIG. 14 shows a structural system including an optional joiner 110 that can be used to join wood member 16 that includes the wood-frame coupling 10 at an angle to an uncoupled column 112. The joiner 110 shows one example of a combination of a portion of a typical beam-column connector device and the wood-frame coupling 10. Includes at least a first joining plate 114 and a second joining plate 116, both of which are joined to the coupling 10, such as by welding. The joiner 110 may be bolted to the uncoupled column 112 as an alternative to a second wood-frame coupling 10. FIGS. 15 and 16 show the structural system that includes one or more tension cables 118 affixed to the coupling 10 on opposite sides of the wood beam 16 running adjacent to the wood beam 16 wherein the beams 16 and cables 118 can be configured in the form of an inverted truss where the axial compression force in the wood beams offset the tension force in the cable.

Figure 17:
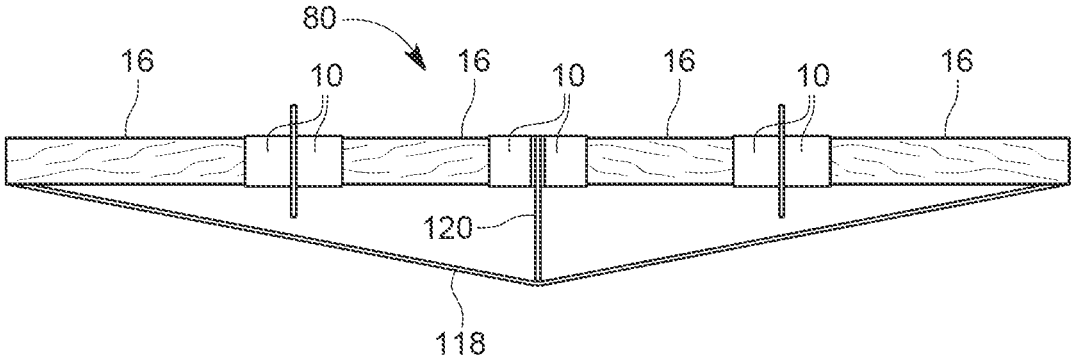
FIG. 17 is a side view of an example segmented beam showing a plurality of wood-frame couplings joining segments together to effect unbraced length reduction and further showing tension cable to aid in prestressing the segmented beam in compression to form the inverted truss mechanism.

It can be seen that the structural system represented in FIG. 16 includes a plurality of beams and a plurality of wood-frame couplings 10. FIGS. 16 and 17 also show the spliced beam 80 option of FIG. 8 to include a king pin plate 120 joined between flanges of adjacent wood-frame couplings 10. The king pin plate 120 may be used to space the underside tension cables 118 away from the spliced beam 80 to a selected degree. The underside cables 118 are used for tension only and are counteracted by an equivalent compression force resisted by beam 16. Using this system, the magnitude of allowable external forces (loads) acting vertically to the tops of the beams 16 can be increased substantially beyond the capacity of the equivalent unspliced beam or spliced beam 80. The length of King pin 120 is selective based on the desired angle between the cable 118 and the beam 16. Increasing King pin length increases said angle and reduces the magnitude of compression and tension that the beam 16 and the cable 118 must resist for a given load acting vertically downward onto the beams 16. It is the beam splice 80 of FIG. 8 that can simplify the installation of this structural system in the field, compared to similar king pin-cable based beam systems using typical methods of construction that are more difficult because the wood-frame couple 10 of the present invention provides a basis for segmental construction practices that simplifies field construction for potential applications such as this.

Figure 18:
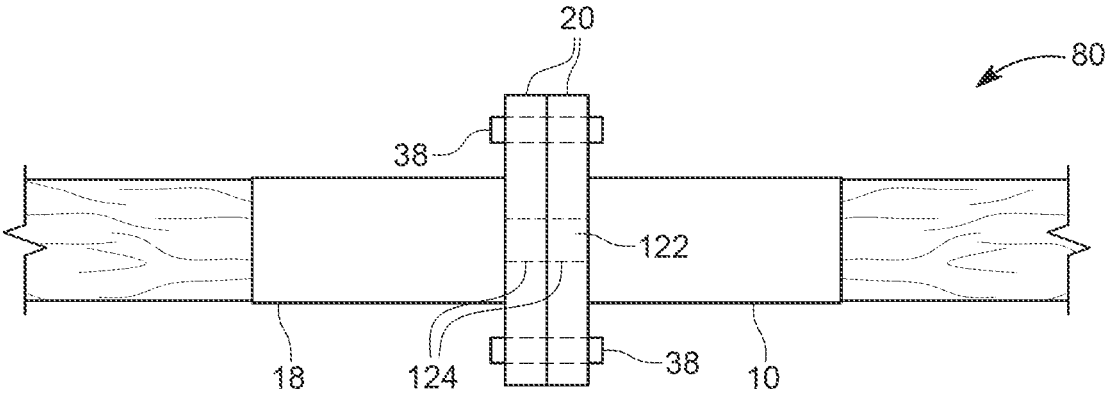
FIG. 18 is a cross sectional side view of a joined wood-frame coupling pair including an optional shear key to reinforce the pairing interface.
Figure 19:
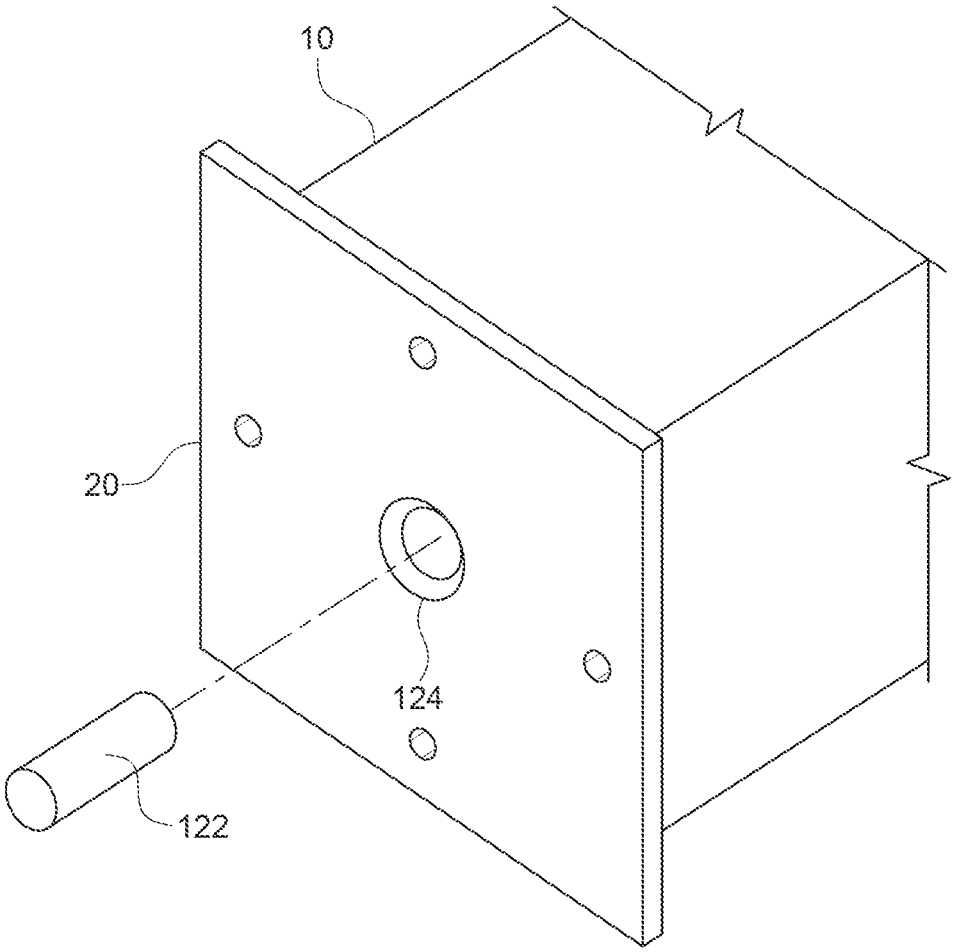
FIG. 19 is a perspective view of the optional shear key of FIG. 18 inserted into a flange of the frame of one of the wood-frame couplings.

While the spliced beam 80 is built by joining together adjacent wood-frame couplings 10, FIGS. 18 and 19 show an optional shear key 122 that may be inserted between the adjacent flanges 20 of the couplings 10. Each flange 20 is modified to include a shear key port 124 at about the center thereof. The shear key 122 can be used to reduce stress on flange bolts 38, such as for the spliced beam 80 as shown but not limited to that particular structure. The pre-drilled hole for the purpose of air relief during fabrication of wood-frame coupling 10 may be also used for shear key port 124.

Figure 20:
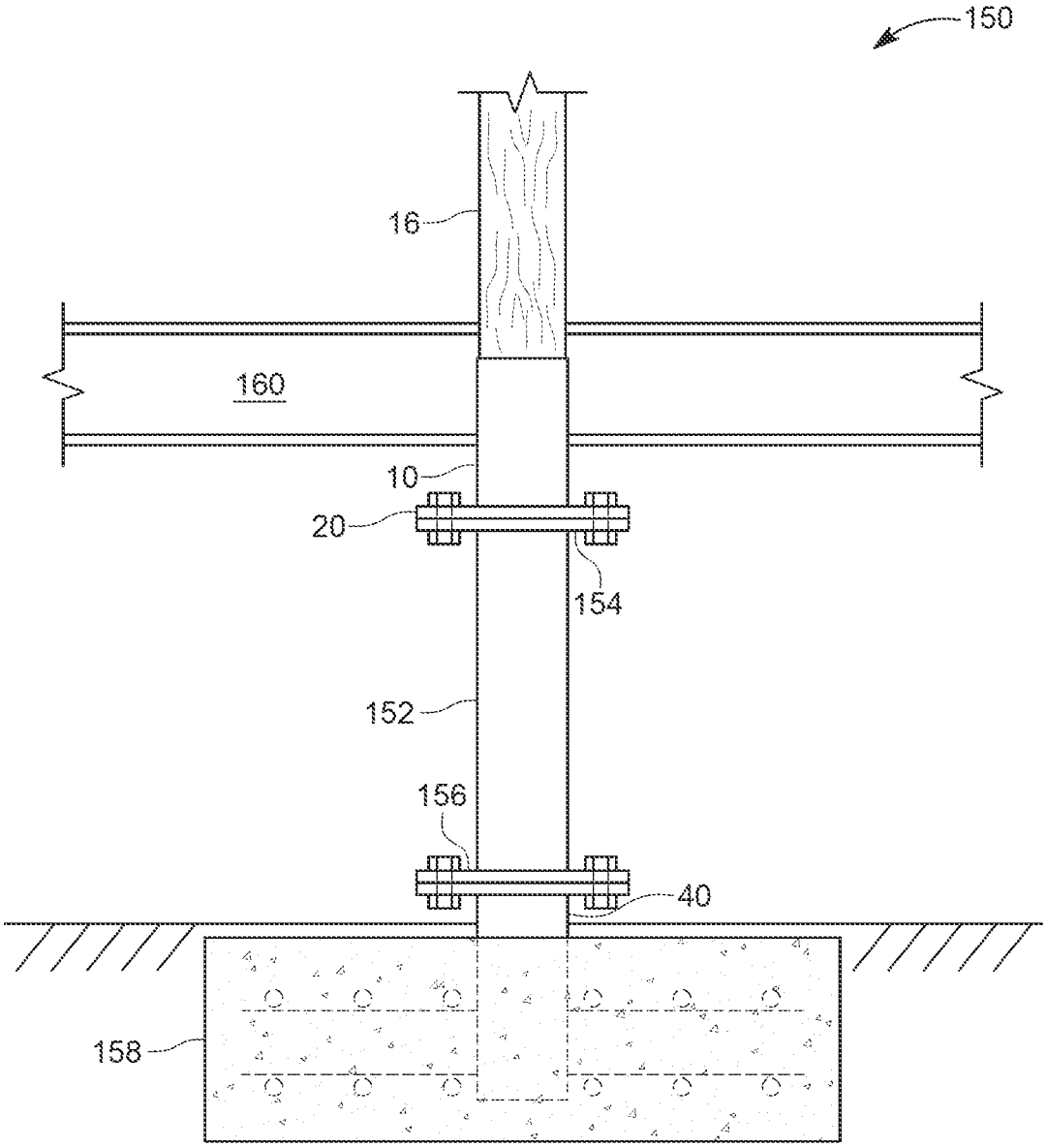
FIG. 20 is a cross sectional side view of the wood-frame coupling of the present invention joined to a lower structural tube steel member in a basement or crawl space location.

A variant of the structure shown in FIG. 3 for joining the wood member 16 to the foundation 44 using the wood-frame coupling 10 is shown in FIG. 20. Structure 150 may be used in a crawl space or basement setting in which a frame extension 152 is connected to the wood-frame coupling 10 by bolting together flange 20 of the wood-frame coupling 10 to a coupling extension flange 154. The extension 152 may be a tube or other structure with sufficient structural integrity to provide moment resistance at least equal to that of the wood member 16 with the coupling 10. The frame extension 152 also includes support flange 156 for connecting the extension 152 to the non-wood structural member 40 that is secured in column footing 158. The extension 152 is of sufficient length to position the wood-frame coupling 10 within or near floor framing 160, which brings the wood member stress point associated with the coupling 10 to a higher elevation. That enhances the structural advantage of the system relative to the wood member 16 by not being required to resist increased moment and deflection that would result from increased length if a wood-only member. This allows the wood portion of the system to be utilized, for aesthetic purposes for example, at higher locations in a building, such as a second floor.

Figure 21:
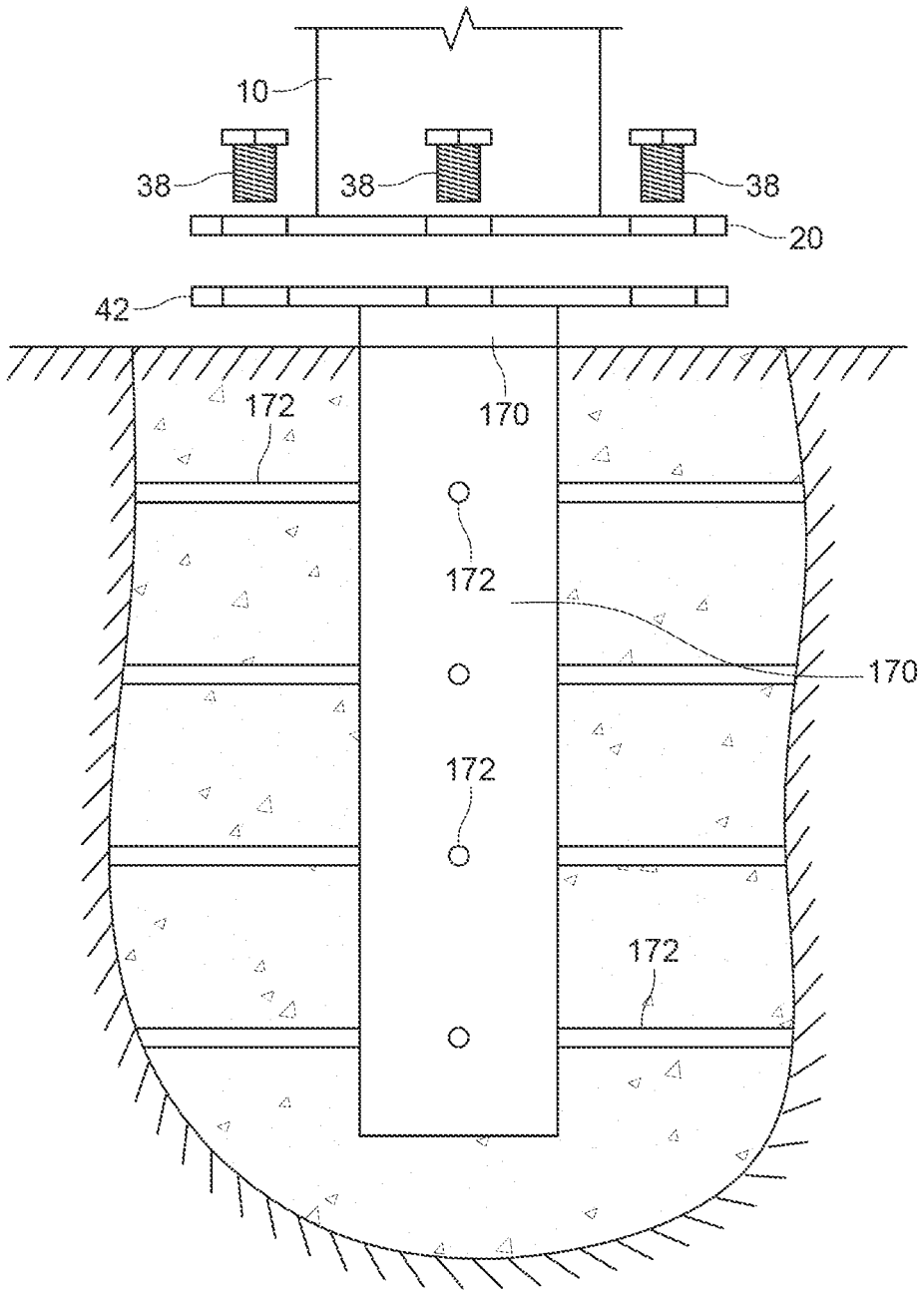
FIG. 21 is a cross sectional side view of the wood-frame coupling of the present invention in position for joining to and extending from a foundation flange.
Figure 22:
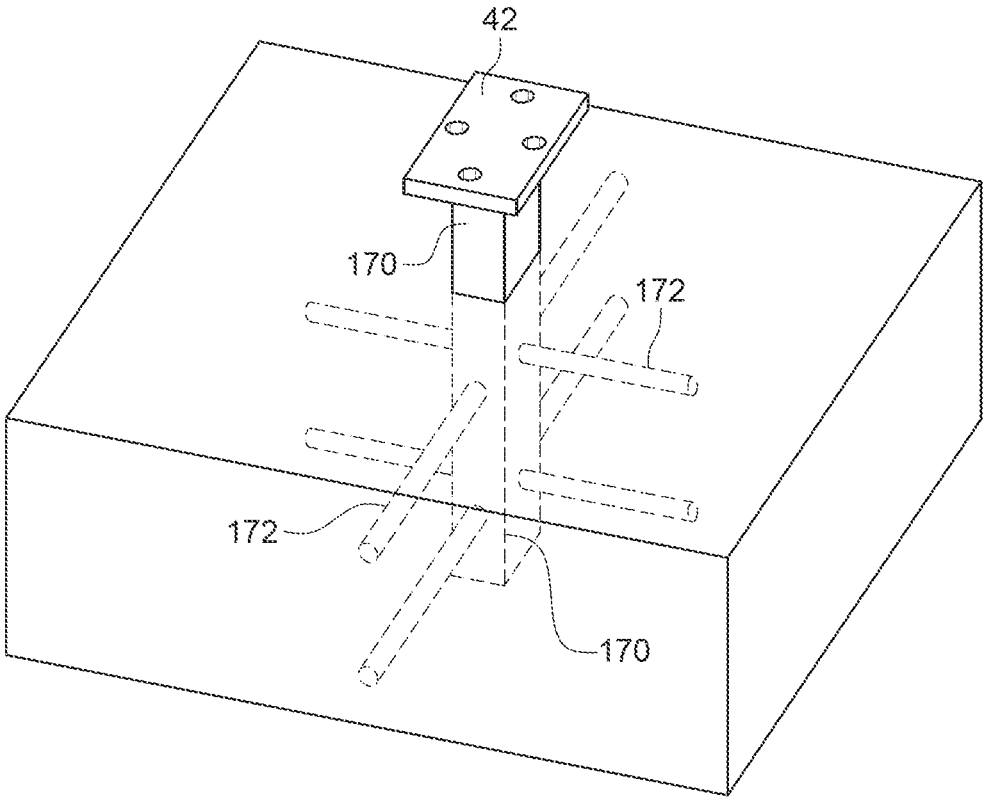
FIG. 22 is a perspective view of the wood-frame coupling inserted into a foundation port with the wood beam extending into the foundation.

FIGS. 21 and 22 show another variant of the structure of FIG. 3. In FIG. 21, the joining flange 42 is affixed to reinforcement attachment post 170. Post 170 is made of a structural material, such as steel. It is modified to include reinforcement steel (rebar) 172, potentially connected in the field just prior to foundation construction and concrete placement. The post 170 is affixed to the wood member 16 via the joining flange 42 and the wood-frame coupling 10 with flange 20.

Figure 23:
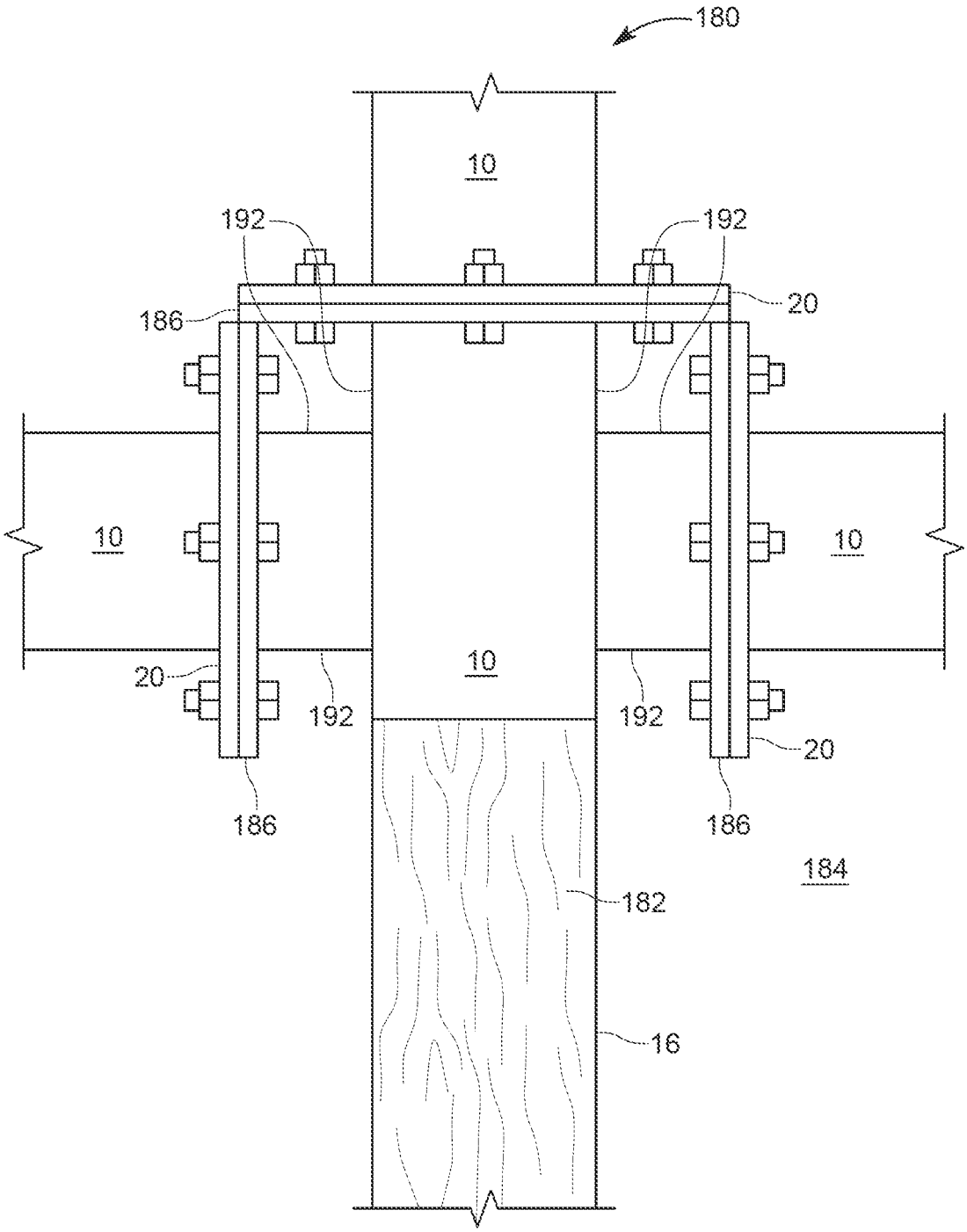
FIG. 23 is a side view of an example column-beam structure formed using a plurality of wood-frame couplings of the present invention utilizing a flange option rather than a receiver option.

FIG. 23 shows an example of a column-beam-column structure 180 for connecting multiple wood-frame couplings at a central joint, including a wood member 16 or other material suitable to serve as structural support column 182 that may be secured in an underlying substrate such as a reinforced concrete foundation as described with respect to FIGS. 21 and 22 The column 182 is configured with a wood-frame coupling 10 that is pre-fabricated by joining multiple flanges 186 via pre-welded steel connectors 192. Connector 192 may consist of shortened frame 12 members or direct pre-weld to side of frame 12 for example. Multiple wood-frame couplings 10 with flange 20 can then be field connected with bolts to multiple flanges 186 to form a moment resistant composite joint that simultaneously connects column-column, column to first beam, column to second beam continuing to potentially connect two columns and four beams at a single moment resistant joint.

Figure 24:
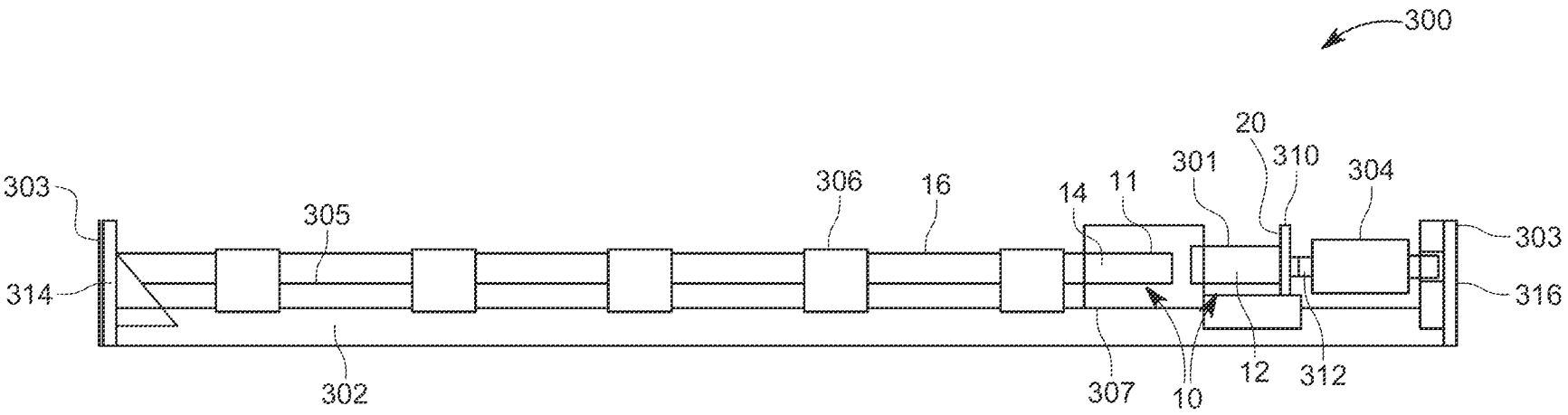
FIG. 24 is a side view of an example apparatus for making the wood-frame coupling.
Figure 25:
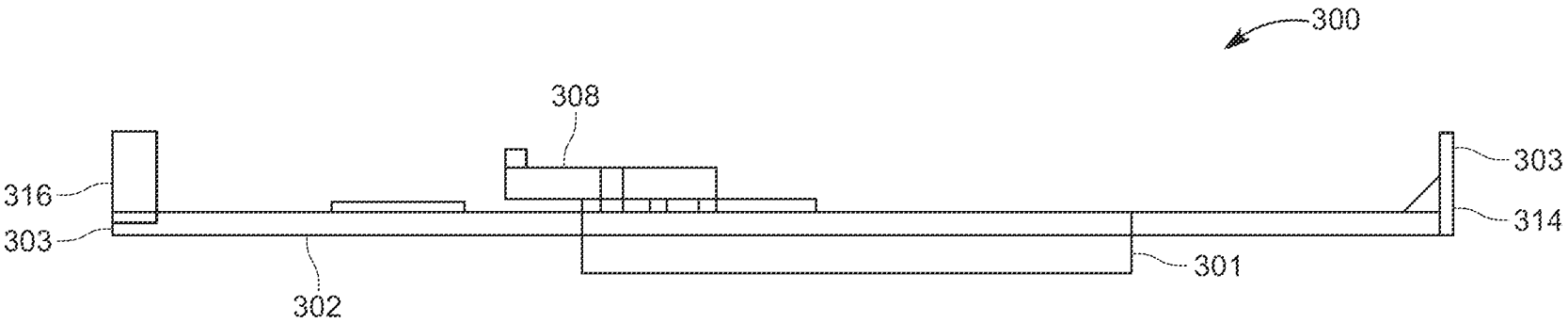
FIG. 25 is a side view of the support and guide plates of the apparatus of FIG. 24.
Figure 26:
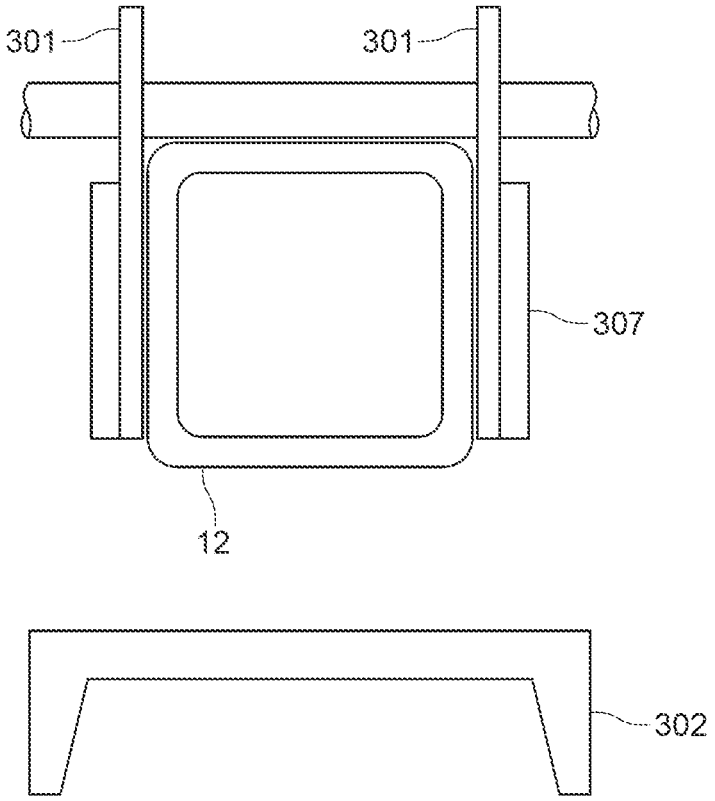
FIG. 26 is an end view of the support and guide plates of the apparatus of FIG. 24.

The wood-frame coupling 10 of the present invention provides a range of opportunities to improve certain building and other structural processes by enabling the use of more wood columns and beams as substantial structural members to support lateral forces by substantially establishing moment resistance in joints not previously considered for wood members. An aspect of the present invention for producing the novel wood-frame coupling 10 is the formation of the coupling 10. As illustrated in FIGS. 24-26, a wood-frame coupling machine 300 provides an apparatus and method for making the coupling 10 using axial compression force as described herein.

The machine 300 includes a wood member support platform 302, axial force guides 301, an axial force generator 304, an adjustable axial restraint system 306 including end plates 303 and 316 and tieback shackling 305, coupling guide 307, and lateral restraints 308 to prevent wood member 16 buckling. The wood member support platform 302 is of selectable length and width chosen to support the wood member 16 and the forces acting axially, laterally, and rotationally during the coupling process thereon. The platform 302 is of sufficient structural integrity to support the weight of the wood member 16 with little to no bending or buckling while the frame 12 is being driven into and onto the end 14 of the wood member 16. Platform 302 must also be of sufficient structural integrity to assist with restraint of end plates 303 and 316 reactions to the applied force that is directed eccentric to the platform longitudinal axis. The platform 302 may be a manufactured structural steel member cut to length, such as a W-section wide-flange member or a C-channel section, or it may be a different manufactured configuration or made of another material.

The axial load generator 304 is a double acting hydraulic cylinder (engine powered with hydraulic pump, fluid reservoir tubing, etc. not depicted) with sufficient axial compression loading capacity to push piston rod 312 to at least about 60,000 lbs. of force, with actual capacity requirements dependent on size and configuration of wood member 16 and frame 12 and depth of perimeter wood material removed from end 14 of wood member 16 by frame 22. Piston rod 312 is connected to a platen 310, with hydraulic cylinder base connected to end plate 303 at end 316 and platen 310 rigidly affixed to piston rod 312. The platen 310 is sized and of sufficient integrity to maintain contact with the flange 20 of the coupling 10, or the bottom of the body 18 if the coupling 10 has no flange, or platen 310 may be substituted with an alternative configurated load distributing element rigidly affixed to piston rod 312 with configuration and structural integrity sufficient transfer load from piston 312 to frame 22 without damaging other optional appurtenances potentially already connected to body 18 and also configured such that the platen 310 or alternative element is guided on loading directional tracks 301 connected to platform 302.

The piston 312 forms part of the force generator 304 and is selected in conjunction with the engine and hydraulic pump to apply sufficient loading to the frame 22 to force it on and into the wood member 16 at the end 14 to fabricate wood-frame coupling 10. The axial restraint system 306 includes two end plates 303 affixed to each end 314 and 316 of the platform 302 along with removable axial force resisting removable inserts for adjusting length of wood member 16 prior to fabricating wood-frame coupling 10. End plates 303 at platform ends 314 and 316 must be connected to the platform 302 and tieback shackling 305 with sufficient structural capacity to resist both tension reaction forces in the tieback shackling 305 and tension reaction forces in platform 302. Moreover, platform 302 must be of sufficient structural integrity and stiffness to also resist extreme compression forces and resultant platform buckling from occurring from undesired eccentric loading directed to end plates 303.

The one or more lateral wood restraints 308 may be fixed or metal straps that are secured about the perimeter of the wood member 16 and connected to platform 302 or another suitable anchoring support during the wood-frame coupling fabrication process. The structural integrity, number, and spacing of the lateral wood restraints is selectable but must be sufficient to substantially prevent bending, buckling, or other lateral, horizontal, or vertical movement of the wood member 16 while on the platform 302 and the generator 304 is activated to cause movement of the frame 12 onto the end 14 of the wood member 16. Coupling guide 307 ensures accurate joining of the frame 12 into and onto wood member 16.

The wood-frame joining machine 300 is used to carry out a method of the present invention for making the wood-frame coupling 10. The method includes a step of placing the wood member 16 on the platform 302. Before or after that step, end 14 of the wood member 16 is optionally scored at least partially around its perimeter to produce slits in the wood member 16 at the end 14. This scoring of the wood member 16 facilitates insertion of the frame 12 on and into the wood member 16 at the end 14 as relief joints. The scoring is optional as dependent on the loading capability of the axial load generator 304, dimensions of wood member 16 and frame 22 and the depth of perimeter wood material removal desired to create the coupling. The wood member 16 is preferably kiln dried or otherwise dried to a satisfactory moisture content prior to placement on the platform 302. The method may be performed as a prefabrication method in a controlled environment rather than on a job site but is not limited thereto.

With the wood member 16 on the platform 302, the axial restraint 306 is connected in correct configuration. The one or more lateral wood restraints 308 are secured about the perimeter of the wood member either in complete or partial contact with the wood member 16 except at the end 14. The frame 22, may optionally be first heated to induce minor quantities of thermal expansion to add a small magnitude of additional permanent strain to the final wood-frame coupling to supplement the constrained compression coupling depending on specific or special applications or environments where the wood-frame coupling 10 will be utilized.

Using wood member 16 elements containing unknown moisture content at time of coupling fabrication should be avoided unless specifically allowable for the intended application or the wood-frame coupling bond will be augmented using attachment means such as fasteners such as screws or bolts, adhesives, such as epoxy adhesives, or the like, connecting through frame 22 to end 14 of wood member 16 in a configuration determined sufficient to provide the additional connection capacity potentially needed for the intended application. Moreover, even if initial moisture content at coupling fabrication does not present a concern for future shrinkage, the wood-frame coupling 10 can nevertheless be enhanced by adding such fasteners, adhesives, or the like thereto.

The frame 12 is positioned in contact with the bottom of the wood member 16 at the end 14 and aligned by the coupling guide 307 that is constructed and attached to the apparatus in a manner and with sufficient strength and stiffness to restrain frame 12 from deviating off proper course into and onto wood member 16 at end 14 until sufficient connection length of frame 12 on wood member 16 prohibits any course deviation. That positioning is made to ensure that the inner perimeter of the frame 12 is substantially aligned with the outer perimeter of the wood member 16 at the end 14. Once that alignment is confirmed, the platen 310 of the generator 304 is placed in contact with the base of the flange 20, or directly with the base of the body 18 if there is no flange 20. The generator 304 is activated and the piston 312 actuated to move the platen 310 along the force directional guide tracks, which moves the frame 12 so that it is forced on and into the end 14 of the wood member 16 while guided by coupling guide 307. In the early stages, the movement of the piston 312 may be halted periodically to confirm maintenance of the frame-wood alignment with the understanding that frame 22 inserted even a small fraction of the full frame insertion distance on or into end 14 of wood member 16 may be sufficient to prohibit alignment adjustments. The piston 312 and the platen 310 are retracted when the frame 12 is fully or effectively on and in the end 14 of the wood member 16. The wood member 16 may then be removed from the platform 302 and the establishment of the wood-frame coupling 10 then confirmed.

Figure 27:
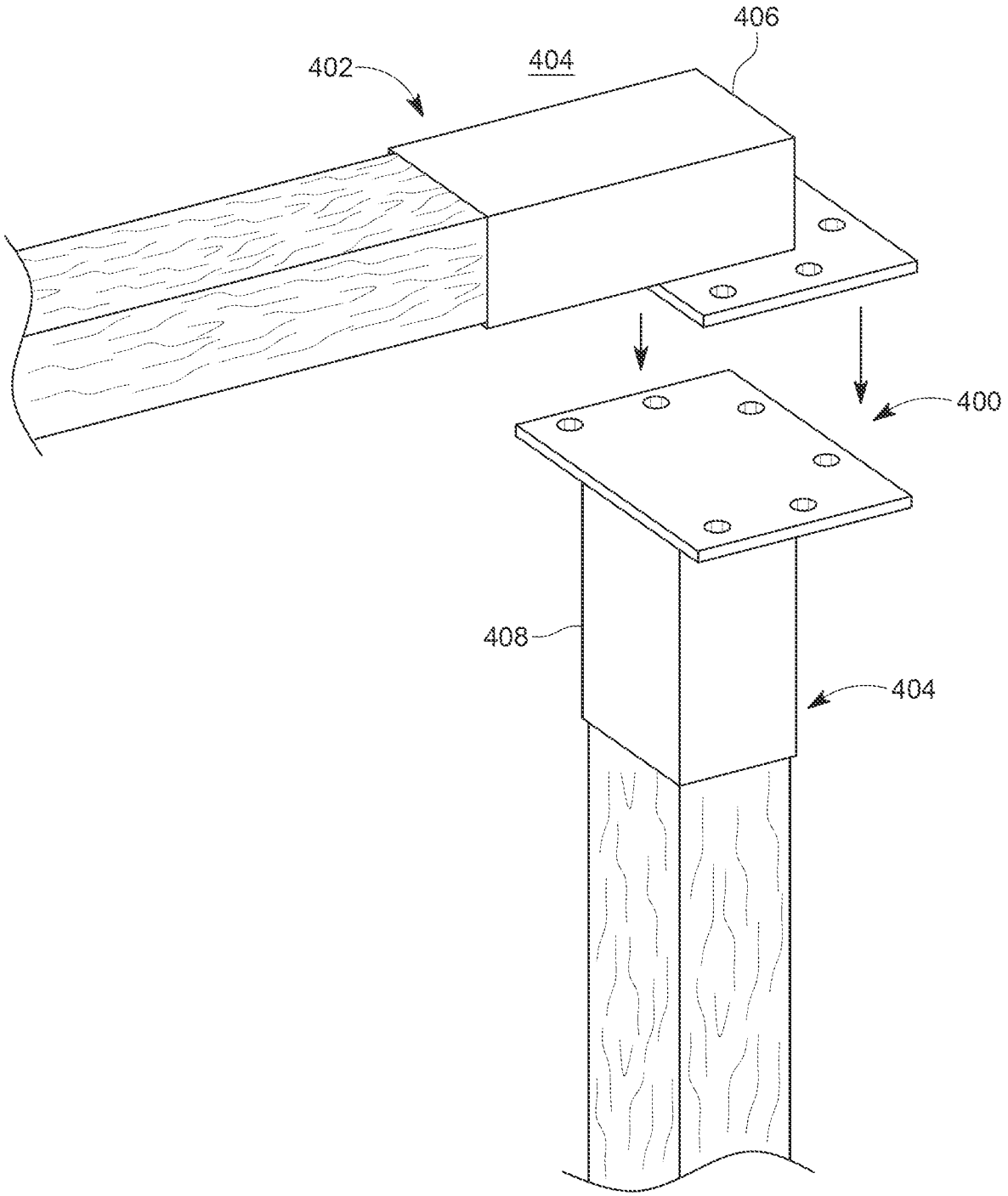
FIG. 27 is a top perspective view of a moment resistant beam-column connection using the wood-frame coupling of the present invention joining the beam and column together with flanges.

A first embodiment of a moment resistant beam-column connection 400 using the wood-frame coupling 10 is shown in FIG. 27. The connection 400 includes beam 402 and column 404 in position to be connected together using beam coupling 406 and column coupling 408. Each of the beam coupling 406 and the column coupling 408 may be the wood-frame coupling 10 as described herein. The beam coupling 406 is affixed to a transverse flange 410 and the column coupling 408 is affixed to an axial flange 412. The transverse flange 410 and the axial flange 412 are joined together to form the connection 400 that establishes a substantial moment resistant beam-column structure 414.

Figure 28:
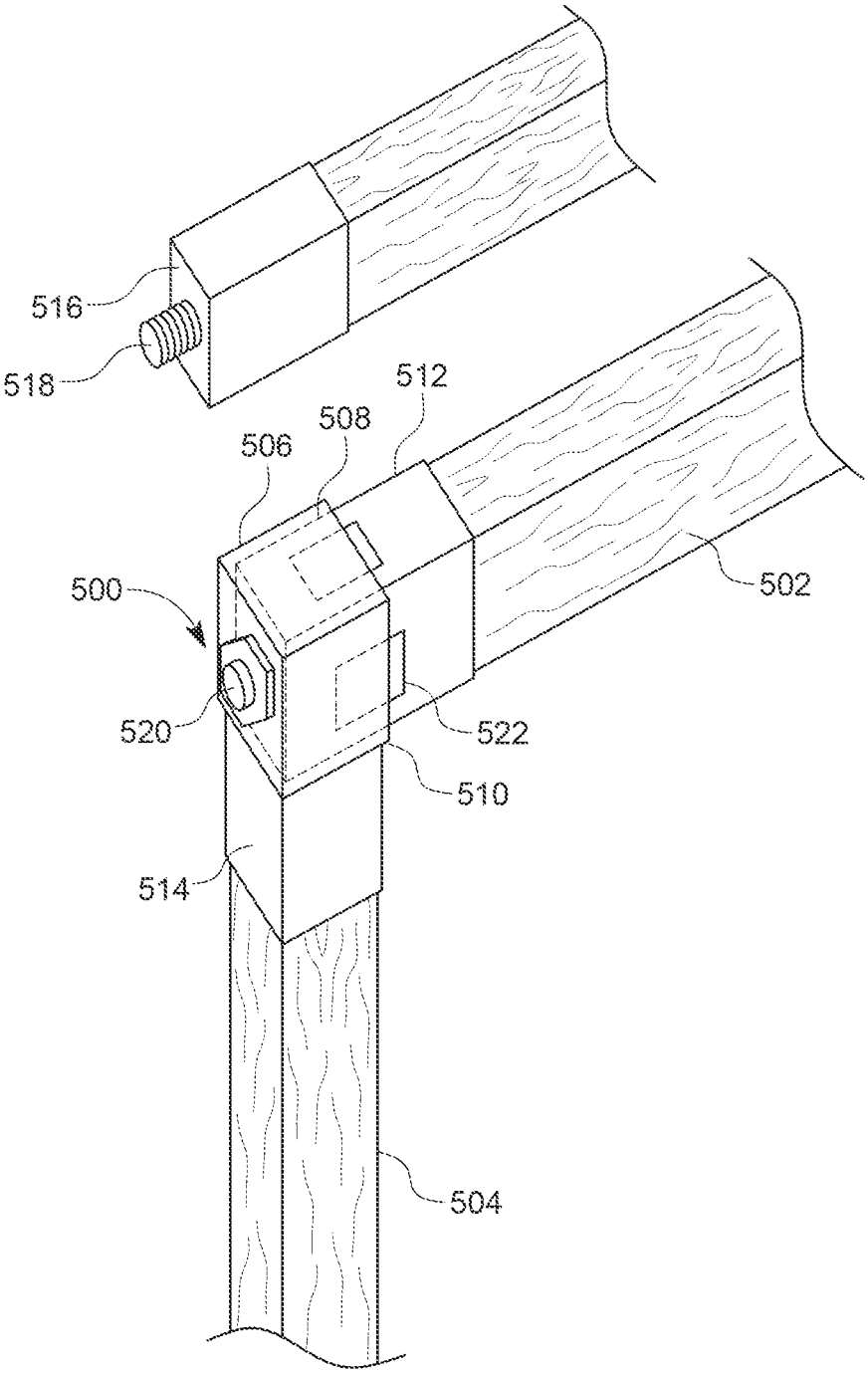
FIG. 28 is a top perspective view of a moment resistant beam-column connection using the wood-frame coupling of the present invention joining the beam and column together with a receiver.

A second embodiment of a moment resistant beam-column connection 500 using the wood-frame coupling 10 is shown in FIG. 28. The connection 500 includes beam 502 and column 504 connected together using beam-column moment frame receiver 506. The receiver 506 includes a beam port 508 and a column port 510. The beam port 508 is sized to receive therein beam coupling 512, which may be the wood-frame coupling 10 as described herein. The column port 510 is sized to receive therein column coupling 514, which may be the wood-frame coupling 10 as described herein. The beam coupling 512 includes at end plate 516 a receiver securing bolt 518 that is used to secure the receiver 506 to the beam coupling 512 such as with nut 520. Alternatively, the receiver 506 may be secured to the column coupling 514 during prefabrication by welding, either before or after completion of the wood-frame coupling. One or more steel shims 522 may be used to fully eliminate looseness in the joining of the receiver 506 to either or both of the beam coupling 512 and the column coupling 514. That is, the shims 522 will work to lock the movement resistance plus allow a little flexibility in the direction the wood member 16 is pointed.

Figure 29A:
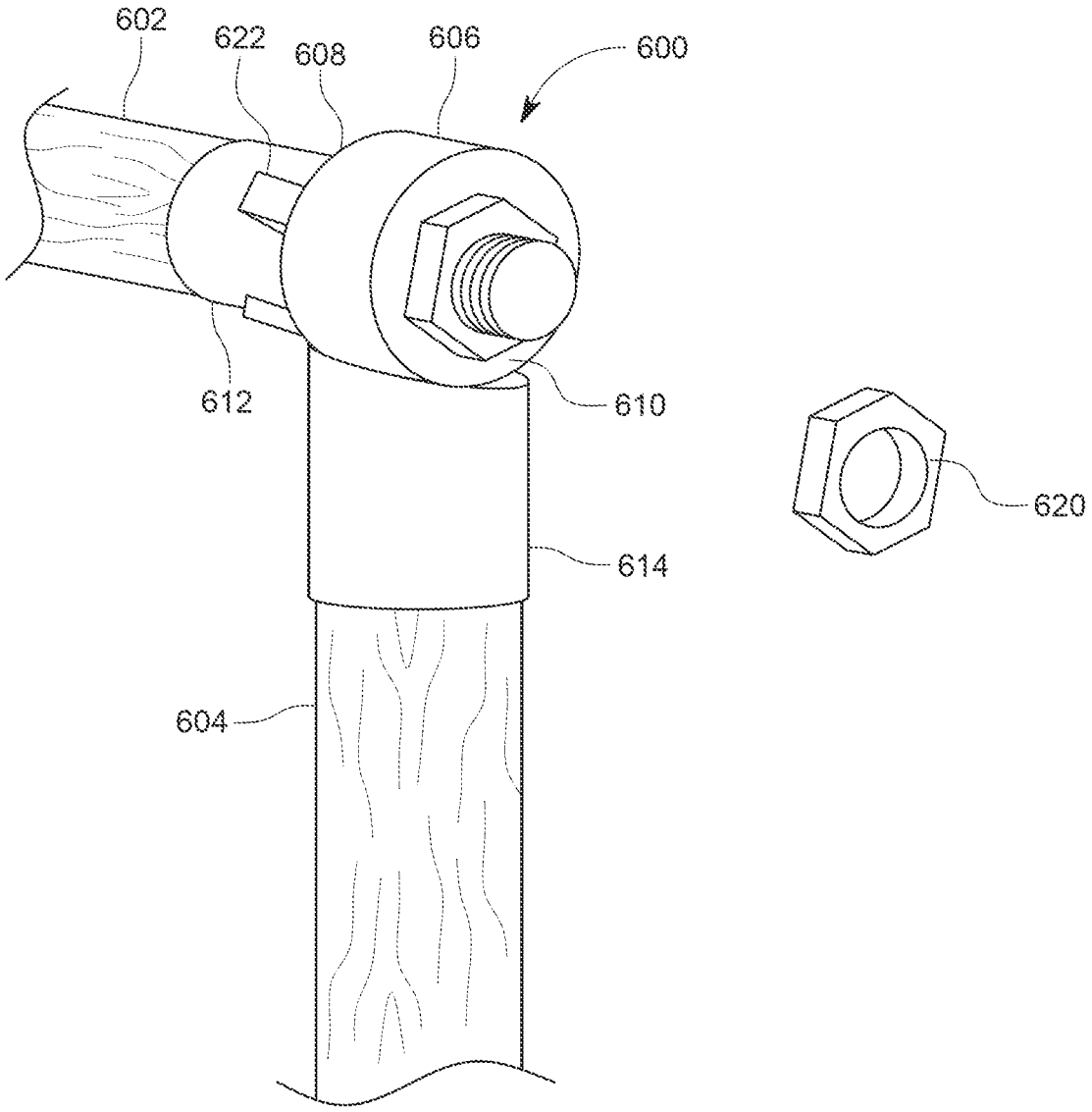
FIG. 29A is a perspective view of a moment resistant beam-column connection using the wood-frame coupling of the present invention with round wood members, round frames, and round receiver for joining the beam and column together.
Figure 29B:
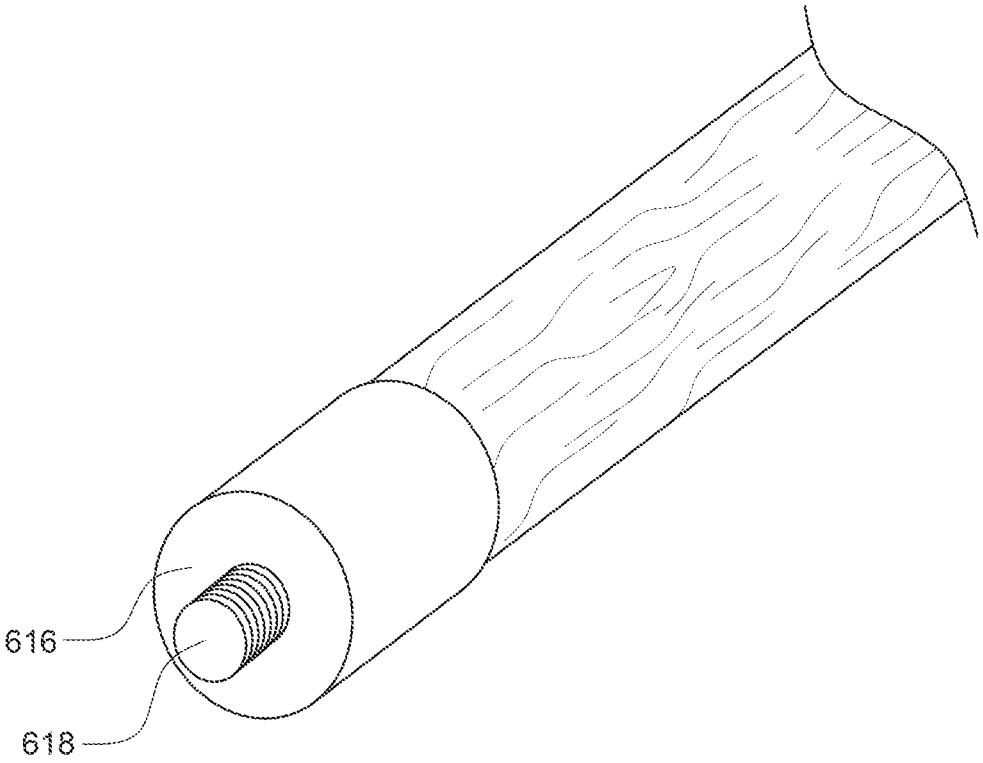
FIG. 29B is a perspective view of a wood member with bolt receiving port of a wood-frame coupling.
Figure 29C:
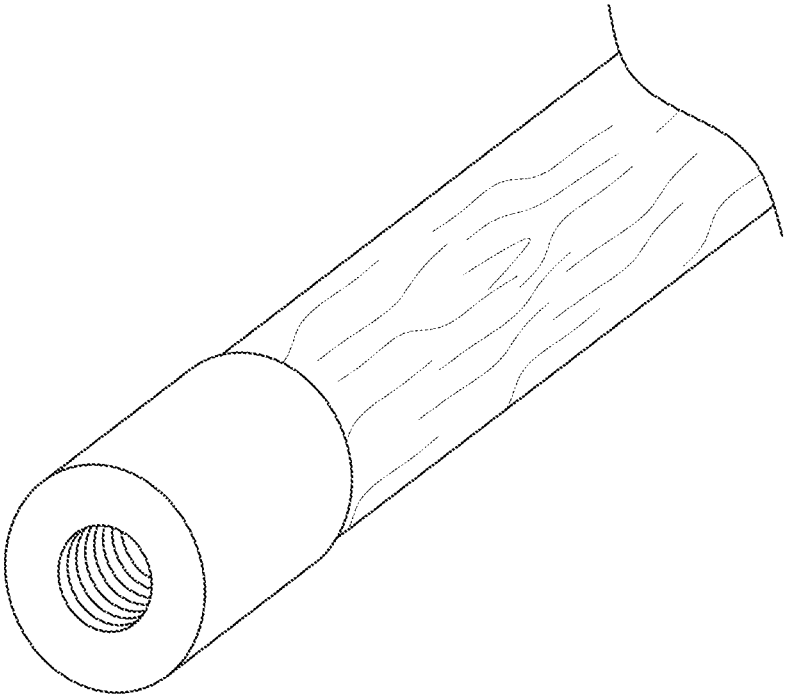
FIG. 29C is a perspective view of a wood member with a bolt of a wood-frame coupling.

A third embodiment of a moment resistant beam-column connection 600 using the wood-frame coupling 10 is shown in FIGS. 29A-29C wherein the wood members and the frames are round instead of rectangular. The connection 600 includes beam 602 and column 604 connected together using beam-column moment frame receiver 606. The receiver 606 includes a beam port 608 and a column port 610. The beam port 608 is sized to receive therein beam coupling 612, which may be the wood-frame coupling 10 as described herein. The column port 610 is sized to receive therein column coupling 614, which may be the wood-frame coupling 10 as described herein. The beam coupling 612 includes at end plate 616 a receiver securing bolt 618 that is used to secure the receiver 606 to the beam coupling 612 such as with nut 620. Alternatively, the receiver 606 may be secured to the column coupling 614 during prefabrication by welding, either before or after completion of the wood-frame coupling. One or more shims 622 may be used to eliminate all looseness in the joining of the receiver 606 to either or both of the beam coupling 612 and the column coupling 614. The shims 622 will work to lock the movement resistance plus allow a little flexibility in the direction the wood member 16 is pointed.

Figure 30A:
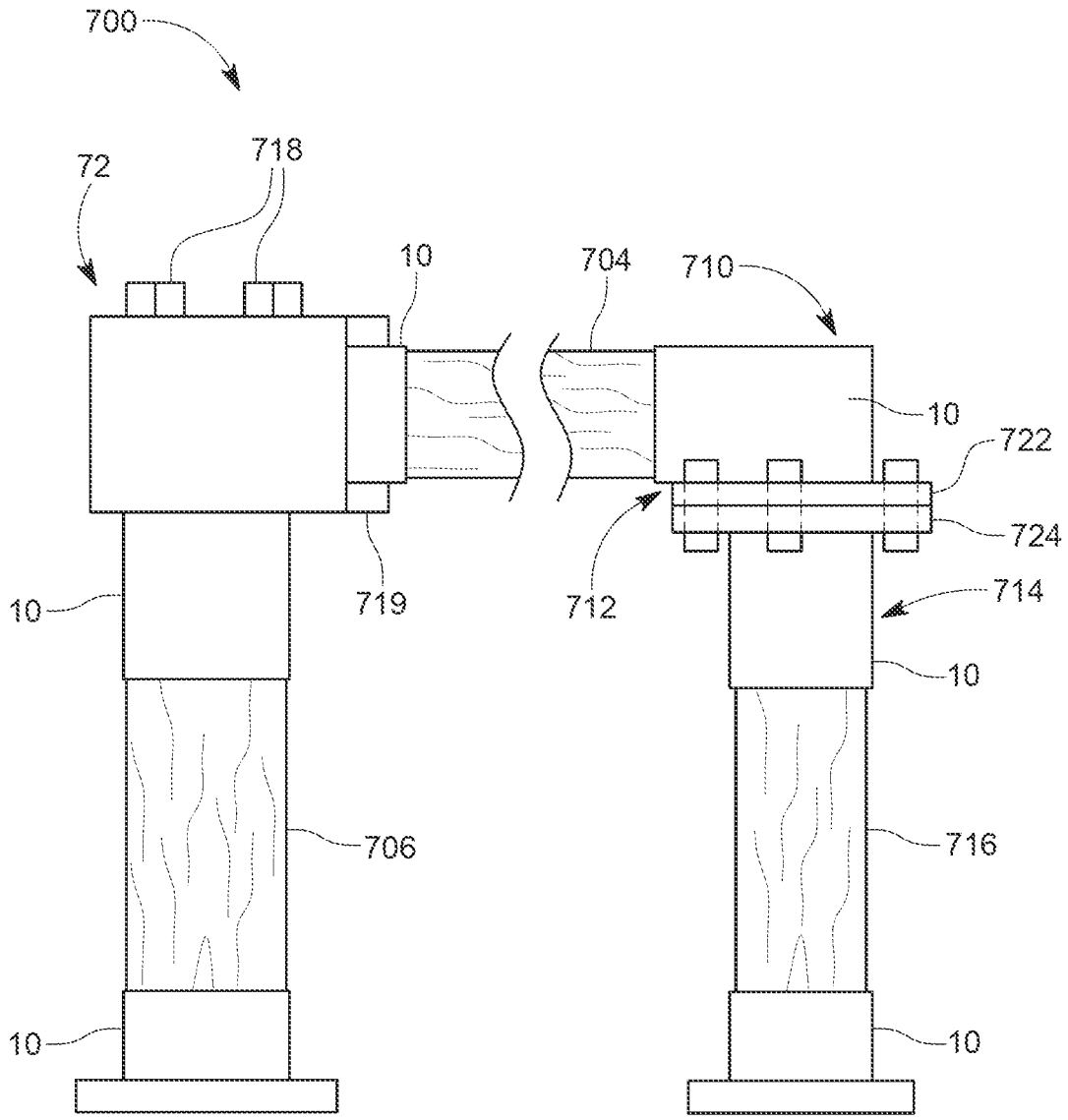
FIG. 30A is a side view of moment resistant beam column connection set showing two columns connected to a beam and showing a receiver with set bolt connecting a first end of the beam to one column and a flange set connecting a second end of the beam to the other column.
Figure 30B:
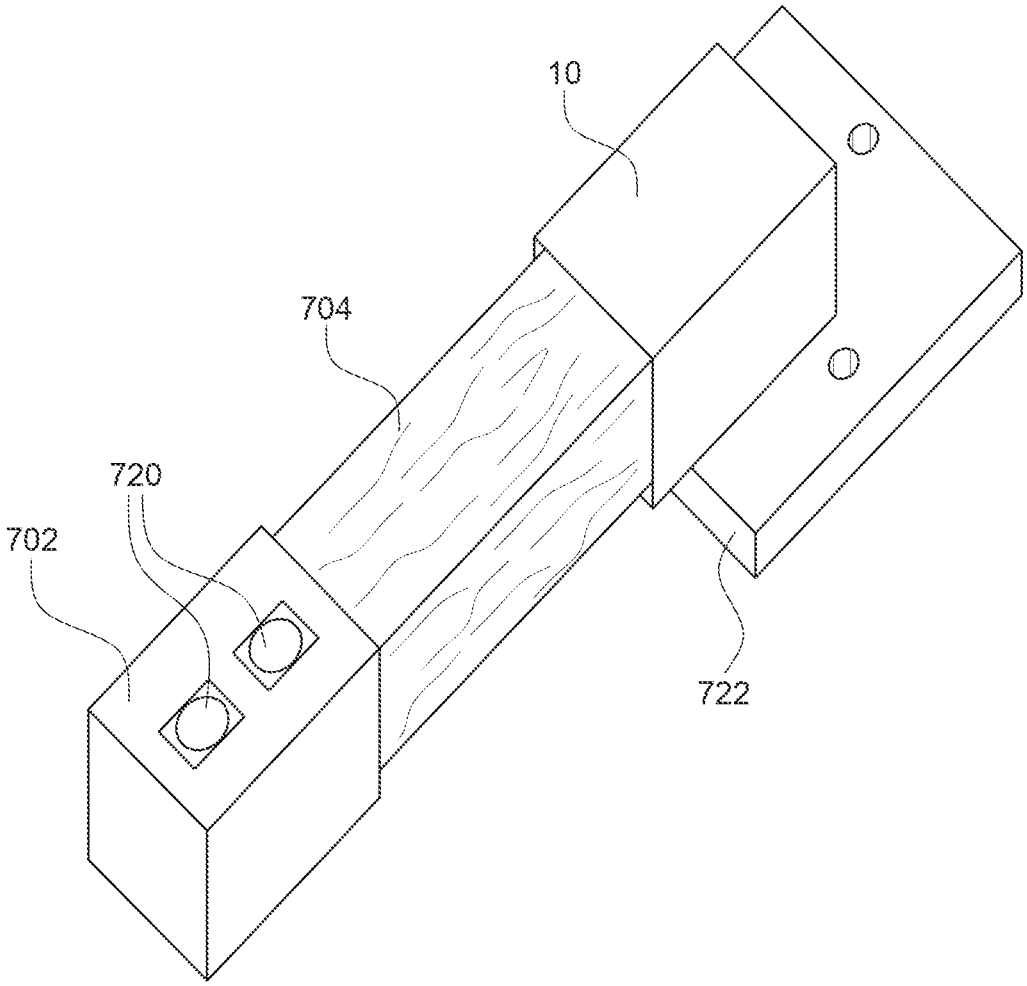
FIG. 30B is a top perspective view of the beam with receiver.
Figure 30C:
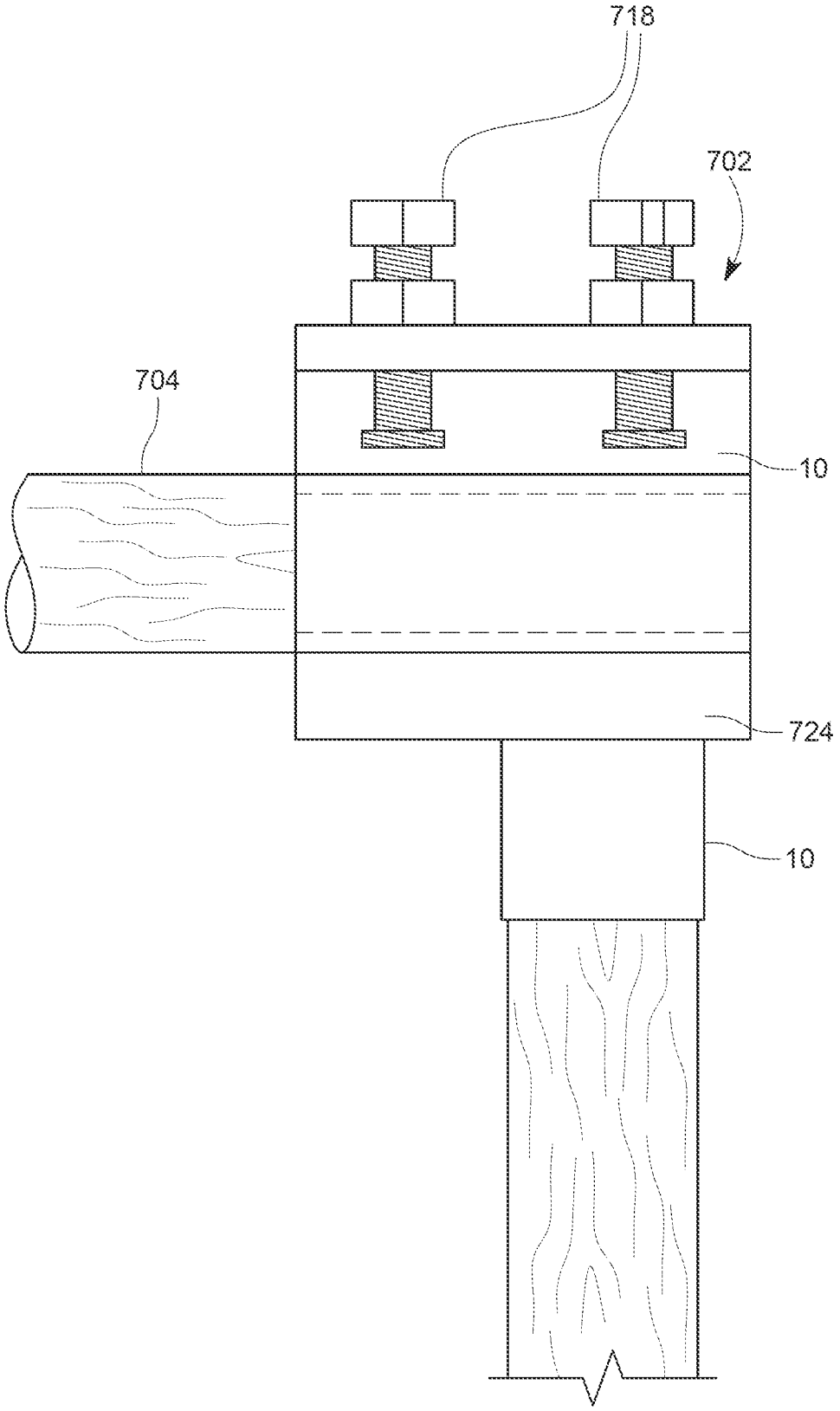
FIG. 30C is a cross-sectional side view of the connection with the receiver.

FIGS. 30A-30C illustrate another moment resistant beam-column structure 700 that includes the use of a plurality of the wood-frame couplings 10. The structure 700 includes a beam-column moment frame receiver 702 for joining a first end of a beam 704 to a first column 706 to form a first moment resistant beam-column structure 708. The structure 700 also includes a second moment resistant beam-column structure 710 that includes a beam coupling 712 and a column coupling 714 for joining a second end of the beam 704 to a second column 716. Shims 719 may be used to eliminate movement of the wood-frame coupling 10 in the receiver 702.

The receiver 702 is similar to other such receivers described herein and further includes a plurality of set bolts 718 removably insertable into set bolt ports 720 of the receiver 702. The set bolts 718 are used to secure the receiver 702 to the woodframe coupling 10 of the beam 704 as shown by tightening them to the wood-frame coupling of the first end of the beam 704. Alternatively or additionally, the receiver 702 may also include set bolts for securing the receiver 702 to the wood-frame coupling 10 of the first column 706.

Each of the beam coupling 712 and the column coupling 714 may be the wood-frame coupling 10 as described herein and configured substantially as shown for the connection 400 of FIG. 27. Specifically, the beam coupling 712 is affixed to a transverse flange 722 and the column coupling 714 is affixed to an axial flange 724. The transverse flange 722 and the axial flange 724 are joined together to form the second moment resistant beam-column structure 710.

Figure 31A:
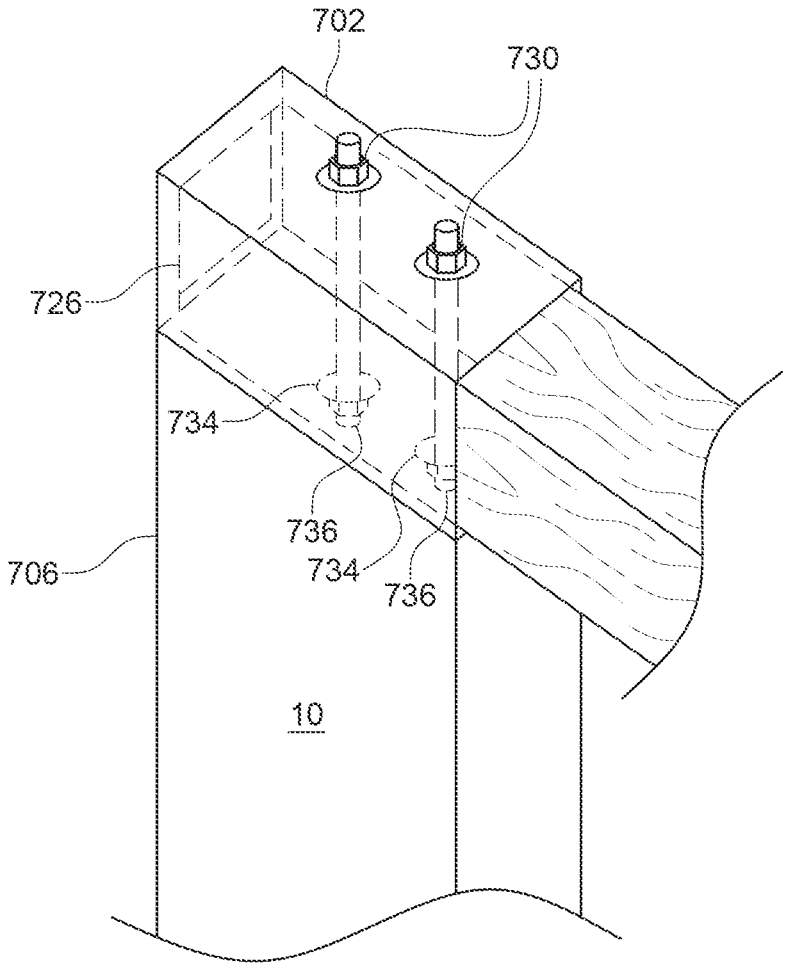
FIG. 31A is a top perspective view of a moment resistant beam-column connection using the wood-frame coupling of the present invention modified to join with a receiver to secure the frame to the receiver with one or more through bolts and FIG. 31B shows the frame with though ports for bolts.
Figure 31B:
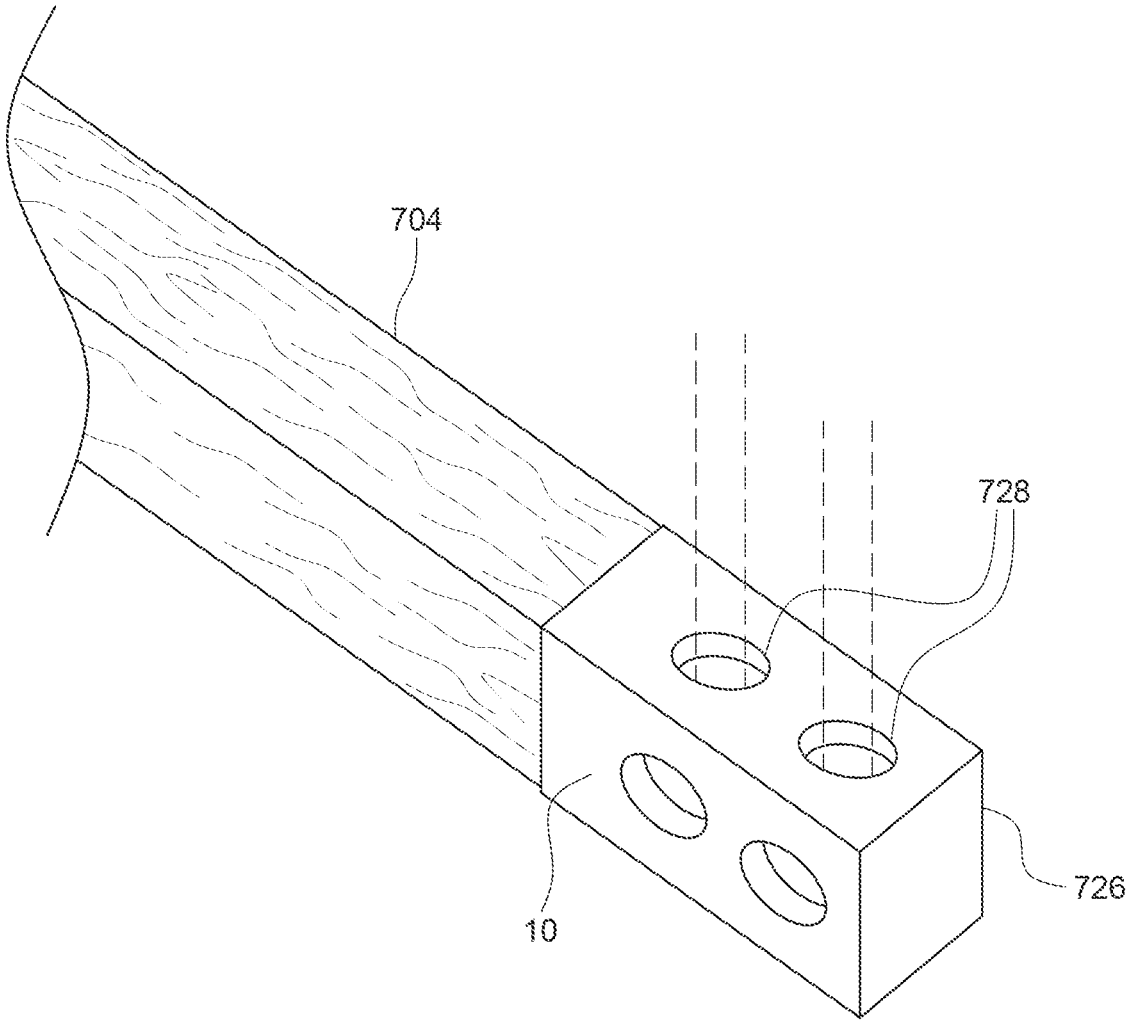

FIGS. 31A and 31B illustrate an alternative embodiment for securing a modified version of the receiver 702 of FIG. 30 to a modified wood-frame coupling 726 of the beam 704. In this embodiment, the wood-frame coupling 726 includes a plurality of through ports 728. Through bolts 730 are inserted into first bolt ports 732 of the receiver 702, into the through ports 728 of the wood-frame coupling 726, and out of the receiver 702 via second bolt ports 734. Nuts 736 may be used to removably secure the wood-frame coupling 726 in the receiver 702 to establish the first moment resistant beam-column structure 708.

Figure 32:
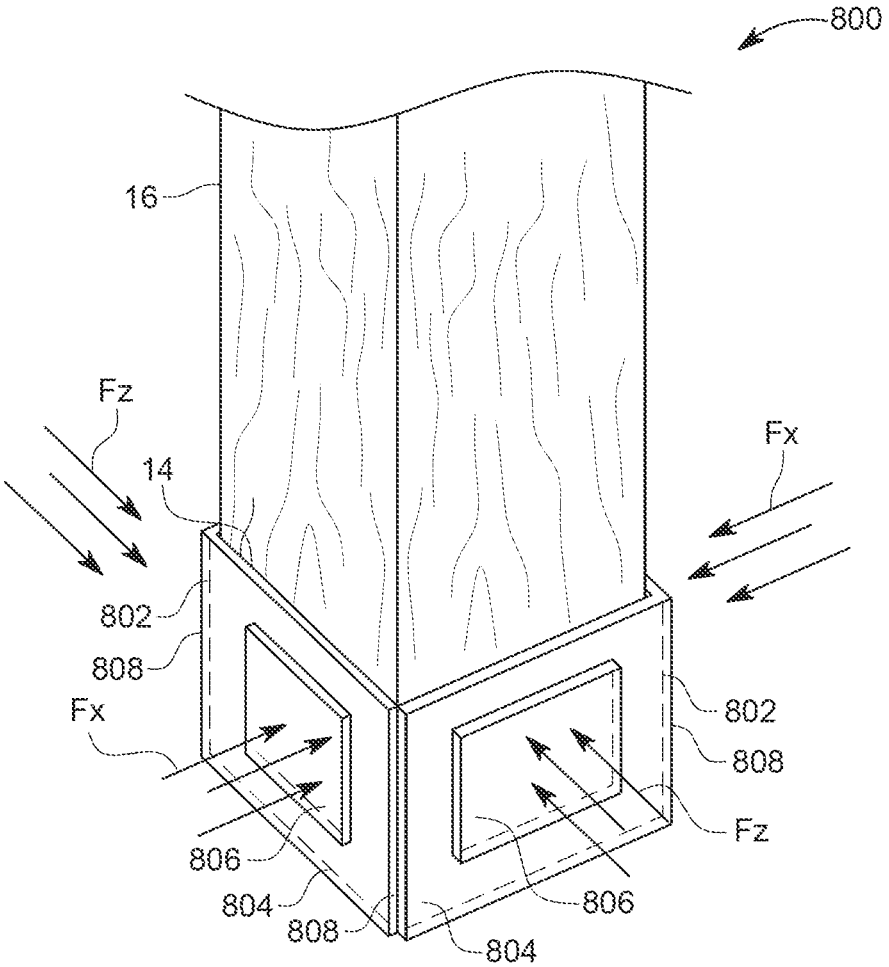
FIG. 32 is a perspective view of an alternative method of making the wood-frame coupling by pressing frame plates onto the end of the wood member while securing the frame plates together.

The wood-frame coupling 10 previously described herein involves the use of a preformed version of the frame 12, wherein the frame 12 is forcibly coupled to the end 14 of the wood member 16. An alternative embodiment of a wood-frame coupling 800 is shown in FIG. 32. The wood-frame coupling 800 includes the wood member 16 and an attachable frame 802. The frame 802 includes a plurality of frame plates 804 positioned about the end 14 of the wood member 16. The frame plates 804 are not initially connected together. Instead, each of the plates 804 is forced onto the wood member 16 using a pressure plate 806. Force is applied substantially simultaneously to each of the pressure plates 806 to compress the frame plates 804 onto the wood member 16 about its perimeter at the end 14 inducing substantially uniform strain. In one version of the wood-frame coupling 800, when sufficient static pressure is applied substantially uniformly so that edges 808 of adjacent frame plates 804 come in substantial contact with one another, the edges 808 thereof are welded together to form the frame 802. The pressure plates 806 are then removed and the wood-frame coupling 800 is established through the permanent confinement of the induced strain as constrained compression. As with fabrication of wood-frame coupling 10, significantly dried wood is required for the wood-frame coupling 800. Moreover, the optional thermal expansion potentially used in conjunction with fabrication of wood-frame coupling 10 is intrinsically included with fabrication of coupling 800 given the required welding processes. On that basis, plate length must be appropriately sized to ensure the welding heat induced thermal expansion does not result in reduced applied pressure onto wood member 16 by pressure plates 806 because frame plates 804 were enlarged reducing induced strain.

It is to be noted that the joining together of the wood member and the frame to form any of the wood-frame couplings described herein may be augmented with fasteners, such as screws, bolts, or the like. Ports for receiving such fasteners may be formed into at least the frame if only set bolts are used for augmented securing and, optionally, into the frame and wood when augmented securing is provided by through bolts, prior to making the wood-frame coupling. The ports may alternatively be formed into the coupling after the frame and wood member are joined together.

While the present invention has been described with respect to specific example embodiments, it is not intended to be limited thereby. Instead, the scope of the invention is established by its definition in the accompanying claims and equivalents.

What is claimed is:

1. A coupling system to establish a joint that provides movement resistance and moment resistance to a structural member, the system comprising:

a wood-frame coupling comprising a frame having a body including a wall extending continuously therearound and defining an outer wall and an inner wall that establishes an enclosed inner perimeter; and a wood member having an end defining an outer perimeter, wherein the wall of the frame defines an inner space within the inner wall configured to receive a portion of the end of the wood member therein, wherein a cross-sectional area of the inner perimeter of the frame is smaller in magnitude than a cross-sectional area of the outer perimeter of the wood member, wherein the wall of the body of the frame is configured to replace the outer perimeter of the end of the wood member such that there is substantially no gap between the wood member and the frame forming the wood-frame coupling, and wherein the frame is coupled to the end of the wood member by exerting static constrained compression onto the end of the wood member, wherein the compression is established through exertion of an external mechanical force to the end of the wood member by the frame.

2. The system of claim 1, further comprising a flange joined to an end of the body.

3. The system of claim 1, further comprising one or more flanges joined to one or more sides of the body.

4. The system of claim 1, further comprising one or more preformed holes located in an end of the body, one or more sides of the body, or a combination thereof for inserting fasteners, screws, or bolts therein, to augment the wood-frame coupling.

5. The system of claim 1, further comprising a receptacle or multiple receptacles joined in any configuration to the body and arranged to attach and restrain a separate frame with established wood-frame coupling or multiple separate frames with established wood-frame couplings to the body.

6. The system of claim 1, further comprising attachments including hooks, rods, or plates joined in any configuration to the body and arranged to attach and restrain a separate frame with established wood-frame coupling or multiple separate frames with established wood-frame couplings or other wood members to the body.

* * * * *